US009709911B2

(12) United States Patent
Kimura et al.

(10) Patent No.: US 9,709,911 B2
(45) Date of Patent: Jul. 18, 2017

(54) TONER, IMAGE FORMING APPARATUS, AND PROCESS CARTRIDGE

(71) Applicants: Yoshitsugu Kimura, Kanagawa (JP); Ryota Inoue, Shizuoka (JP); Masana Shiba, Shizuoka (JP); Daisuke Inoue, Shizuoka (JP); Tomoki Murayama, Kanagawa (JP); Rintaro Takahashi, Kanagawa (JP)

(72) Inventors: Yoshitsugu Kimura, Kanagawa (JP); Ryota Inoue, Shizuoka (JP); Masana Shiba, Shizuoka (JP); Daisuke Inoue, Shizuoka (JP); Tomoki Murayama, Kanagawa (JP); Rintaro Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/984,411

(22) Filed: Dec. 30, 2015

(65) Prior Publication Data

US 2016/0195826 A1 Jul. 7, 2016

(30) Foreign Application Priority Data

Jan. 5, 2015 (JP) ..... 2015-000394

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01)

(58) Field of Classification Search
CPC ..... G03G 9/08755; G03G 9/08782
See application file for complete search history.

(56) References Cited

U.S. PATENT DOCUMENTS

| | | | |
|---|---|---|---|
| 7,449,273 | B2 | 11/2008 | Ohki et al. |
| 7,459,255 | B2 | 12/2008 | Tanaka et al. |
| 7,504,188 | B2 | 3/2009 | Yamada et al. |
| 7,531,279 | B2 | 5/2009 | Watanabe et al. |
| 8,026,031 | B2 | 9/2011 | Watanabe et al. |
| 8,263,302 | B2 | 9/2012 | Moriya et al. |
| 8,367,293 | B2 | 2/2013 | Ohtani et al. |
| 8,673,528 | B2 | 3/2014 | Sugimoto et al. |
| 8,735,037 | B2 | 5/2014 | Yamashita et al. |
| 8,778,588 | B2 | 7/2014 | Kusahara et al. |
| 8,835,086 | B2 | 9/2014 | Watanabe et al. |
| 8,877,420 | B2 | 11/2014 | Tanaka et al. |
| 9,023,570 | B2 | 5/2015 | Shiba et al. |

(Continued)

FOREIGN PATENT DOCUMENTS

| | | |
|---|---|---|
| JP | 2008-015230 | 1/2008 |
| JP | 2013-137420 | 7/2013 |

OTHER PUBLICATIONS

U.S. Appl. No. 14/669,230, filed Mar. 26, 2015.

*Primary Examiner* — Hoa V Le
(74) *Attorney, Agent, or Firm* — Oblon, McClelland, Maier & Neustadt, L.L.P.

(57) ABSTRACT

A toner including a binder resin and a release agent, wherein the toner has a component soluble in a 50% by mass aqueous methanol solution in an amount of 0.10% by mass to 0.60% by mass, and wherein the toner has a flowing-out beginning temperature (Tfb) of 55.0° C. to 100.0° C. as determined by a flowtester method.

7 Claims, 3 Drawing Sheets

(56) References Cited

U.S. PATENT DOCUMENTS 9,069,288 B2 6/2015 Kojima et al.
9,239,530 B2 * 1/2016 Asahina ..... G03G 9/0821
9,354,533 B2 * 5/2016 Takahashi ..... G03G 9/0804
2004/0265721 A1 12/2004 Matsuoka et al.
2005/0026066 A1 2/2005 Tanaka et al.
2005/0031980 A1 2/2005 Inoue et al.
2005/0164112 A1 7/2005 Ohki et al.
2006/0057488 A1 3/2006 Inoue et al.
2006/0068312 A1 3/2006 Yamashita et al.
2006/0099529 A1 5/2006 Tanaka et al.
2006/0160011 A1 7/2006 Inoue et al.
2006/0210903 A1 9/2006 Ohki et al.
2007/0054210 A1 3/2007 Ohki et al.
2007/0059626 A1 3/2007 Inoue et al.
2007/0141500 A1 6/2007 Sugimoto et al.
2007/0141506 A1 6/2007 Inoue et al.
2007/0218382 A1 9/2007 Emoto et al.
2008/0063972 A1 3/2008 Inoue et al.
2008/0138734 A1 6/2008 Inoue et al.
2008/0226998 A1 9/2008 Ishii et al.
2008/0280224 A1 11/2008 Inoue et al.
2009/0117480 A1 5/2009 Yamada et al.
2009/0162770 A1 6/2009 Sako et al.
2009/0186292 A1 7/2009 Inoue et al.
2009/0202935 A1 8/2009 Moriya et al.
2010/0104965 A1 4/2010 Inoue et al.
2010/0129748 A1 5/2010 Inoue et al.
2010/0183967 A1 7/2010 Sabu et al.
2010/0216068 A1 8/2010 Kotsugai et al.
2010/0310980 A1 12/2010 Sugimoto et al.
2010/0330489 A1 12/2010 Inoue et al.
2011/0003244 A1 1/2011 Inoue et al.
2011/0033794 A1 2/2011 Watanabe et al.
2011/0065033 A1 3/2011 Uchinokura et al.
2011/0065036 A1 3/2011 Inoue et al.
2011/0076610 A1 3/2011 Ogawa et al.
2011/0086308 A1 4/2011 Watanabe et al.
2011/0104608 A1 5/2011 Nakajima et al.
2011/0124838 A1 5/2011 Kotsugai et al.
2011/0129773 A1 6/2011 Shu et al.
2011/0151370 A1 6/2011 Shitara et al.
2011/0223530 A1 9/2011 Inoue et al.
2011/0223532 A1 9/2011 Sugimoto et al.
2011/0255899 A1 10/2011 Iwamoto et al.
2011/0262853 A1 10/2011 Watanabe et al.
2011/0262856 A1 10/2011 Sugimoto et al.
2011/0281213 A1 11/2011 Sakashita et al.
2011/0294058 A1 12/2011 Shiba et al.
2011/0305986 A1 12/2011 Ogawa et al.
2011/0318053 A1 12/2011 Yamashita et al.
2012/0064445 A1 3/2012 Kojima et al.
2012/0189951 A1 7/2012 Sugimoto et al.
2012/0219896 A1 8/2012 Asahina et al.
2012/0288299 A1 11/2012 Uchinokura et al.
2012/0328976 A1 12/2012 Seki et al.
2013/0011778 A1 1/2013 Yamashita et al.
2013/0059247 A1 3/2013 Sugimoto et al.
2013/0095422 A1 4/2013 Yamamoto et al.
2013/0157184 A1 6/2013 Sugimoto et al.
2013/0157193 A1 * 6/2013 Moritani ..... G03G 9/08728 430/109.4
2013/0164669 A1 6/2013 Yamashita et al.
2013/0171554 A1 7/2013 Yamashita et al.
2013/0196260 A1 * 8/2013 Yoshida ..... G03G 9/08755 430/105
2013/0196261 A1 8/2013 Uchinokura et al.
2013/0196263 A1 8/2013 Asahina et al.
2013/0202997 A1 * 8/2013 Iwagoe ..... G03G 9/0819 430/109.4
2013/0216944 A1 * 8/2013 Shiba ..... G03G 9/0819 430/105
2013/0224648 A1 8/2013 Honda et al.
2013/0243488 A1 9/2013 Kojima et al.
2013/0244155 A1 9/2013 Satoh et al.
2013/0244156 A1 9/2013 Kojima et al.
2013/0244157 A1 * 9/2013 Inoue ..... G03G 9/0812 430/105
2013/0244158 A1 9/2013 Awamura et al.
2013/0330522 A1 12/2013 Suzuki et al.
2014/0072349 A1 3/2014 Sakashita et al.
2014/0080046 A1 3/2014 Asahina et al.
2014/0080047 A1 3/2014 Takahashi et al.
2014/0093820 A1 4/2014 Satoh et al.
2014/0220485 A1 8/2014 Kojima et al.
2014/0234767 A1 8/2014 Awamura et al.
2014/0242514 A1 8/2014 Inoue et al.
2014/0272689 A1 9/2014 Yamashita et al.
2014/0272695 A1 9/2014 Moritani et al.
2014/0348545 A1 11/2014 Shiba et al.
2014/0363209 A1 12/2014 Inoue et al.
2015/0024312 A1 1/2015 Shiba et al.
2015/0037718 A1 2/2015 Morita et al.
2015/0198902 A1 7/2015 Saito et al.
2015/0220011 A1 8/2015 Miyaake et al.
2015/0234303 A1 8/2015 Moriya et al.
2015/0234304 A1 8/2015 Nagata et al.
2015/0241804 A1 8/2015 Takahashi et al.
2015/0253687 A1 9/2015 Chiba et al.
2015/0261111 A1 9/2015 Inoue et al.
2015/0261144 A1 9/2015 Sakashita et al.
2016/0195826 A1 * 7/2016 Kimura ..... G03G 9/0821 430/105

* cited by examiner

TONER, IMAGE FORMING APPARATUS, AND PROCESS CARTRIDGE

BACKGROUND OF THE INVENTION

Field of the Invention

The present invention relates to toners, image forming apparatuses, and process cartridges.

Description of the Related Art

Conventionally, an image forming apparatus employing an electrophotography or electrostatic recording manner has been known to develop a latent image with a toner to form an image. In recent years, a low temperature fixed toner capable to be fixed at a lower temperature has been being developed from the viewpoints of enhanced environment consciousness and a lower running cost.

A unit configured to fix the toner usually employs a manner in which a heat-melted toner is pressured. In this manner, in order to fix the toner at a low temperature, the toner is required to be melted at a lower temperature. However, when a melting temperature of the toner is too low, the toner is prematurely softened before fixing, resulting in failure regarding to toner replenishment or image quality. In order to eliminate such trade-off, the toner is basically designed to melt sharply so as to give steep slope of change of melt viscosity against temperature.

To achieve this, it has been examined to decrease a molecular weight and narrow a molecular weight distribution of a binder resin contained in a toner as possible. Japanese Patent Application Laid-Open (JP-A) No. 2013-137420 discloses an attempt to use a plasticizer or a crystalline material. Specifically, JP-A No. 2013-137420 discloses an attempt to control an endothermic peak temperature and a molecular weight of a crystalline polyester to thereby improve a low temperature fixing property and heat resistant storability, The binder resin often contains oligomers, and monomers or hydrolysate remaining after synthesis as low molecular weight components having the molecular weight of 1,000 or less. For example, polyester commonly used in the toner contains various alcohols, carboxylic acids, and low molecular weight esters because an esterification reaction for synthesizing the polyester is an equilibrium and reversible reaction.

The low molecular weight components contribute to low temperature fixing owing to its low molecular weight, but are likely to absorb moisture in an atmosphere owing to the presence of polarity groups (e.g., carboxyl group and hydroxyl group) in a relatively high ratio. Therefore, when the toner is stored or used under a high temperature and high humidity environment such as the rainy season in Japan, the toner is deteriorated in charging ability over time. In particular, as the binder resin is decreased in molecular weight in order to achieve the low temperature fixing, a percentage of the low molecular weight components is increased relative to the total resin. As a result, it has been known that the toner is greatly deteriorated in charging ability, leading to unstable developing ability of the toner and poor image quality.

In order to solve the above problem, JP-A No. 2008-015230 discloses an attempt that an acid value and a hydroxyl value of a certain toner material is decreased to a predetermined value or lower. A relationship between a flowing-out beginning temperature of the toner and a melting point of the crystalline polyester is also examined to improve the low temperature fixing property and prevent reduction in image density under the high temperature and high humidity environment.

However, in view of the low temperature fixing property of the toner, the acid value and the hydroxyl value are believed to have a suitable range. Therefore, it is inappropriate to decrease the values too much. In JP-A No. 2008-015230, the acid value and the hydroxyl value are defined for only the certain toner material. However, chargeability of the material is affected by its surface-exposed amount on toner particles, and, in turn, the surface-exposed amount varies with each production step, in particular, toner forming step, so that an expected effect cannot be achieved in some cases, which is problematic.

From the above, reduction of a charging amount of the toner affected by temperature and humidity is problematic in designing a toner having satisfactory low temperature fixing property which has been recently demanded. Therefore, there is a need for achieving both a good low temperature fixing property and a reduced change of charging amount. Further, there is a need for a toner having excellent hot offset resistance and storability while achieving both a good low temperature fixing property and a reduced change of charging amount affected by temperature and humidity.

SUMMARY OF THE INVENTION

The present invention aims to solve the above existing problems and achieve the following object. An object of the present invention is provide a toner having a reduced change of charging amount even in a high temperature and high-humidity storage environment, good low temperature fixing property, hot offset resistance, and excellent storability.

In order to solve the above existing problems, a toner of the present invention includes a binder resin and a release agent. The toner has a component soluble in a 50% by mass aqueous methanol solution in an amount of 0.10% by mass to 0.60% by mass, and a flowing-out beginning temperature (Tfb) of 55.0° C. to 100.0° C. as determined by a flowtester method.

According to the present invention, there can be provided a toner having a reduced change of charging amount even in a high temperature and high-humidity storage environment, good low temperature fixing property, hot offset resistance, and excellent storability.

DETAILED DESCRIPTION OF THE INVENTION

Figure 1:
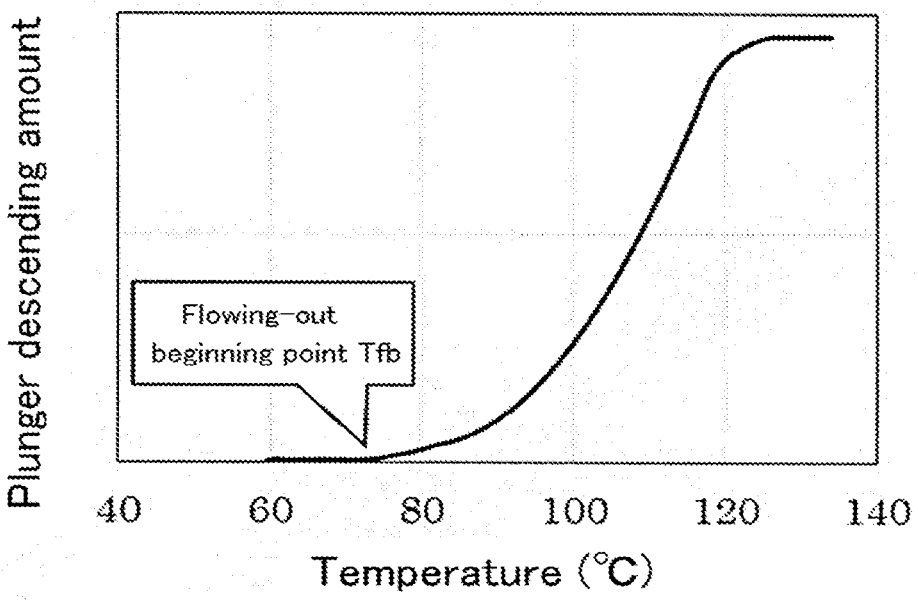
FIG. 1 is one exemplary flowing-out curve obtained using an elevated flowtester.

A toner, an image forming apparatus, and a process cartridge according to the present invention will now be described referring to figures. Note that, the present invention is not limited to the below described embodiments and can be varied within a range that those skilled in the art can conceive. For example, other embodiments, addition, change, or deletion may be made. Any of the aspects is within the scope of the present invention as long as operation and effect of the present invention are realized thereby.

(Toner)

A toner of the present invention includes a binder resin and a release agent; and, if necessary, may further include other materials such as a colorant, a charging control agent, and an external additive. The toner of the present invention has a component soluble in a 50% by mass aqueous methanol solution in an amount of 0.10% by mass to 0.60% by mass, and a flowing-out beginning temperature (Tfb) of 55.0° C. to 100.0° C. as determined by a flowtester method.

<Amount of Component Soluble in 50% by Mass Aqueous Methanol Solution>

The present inventors conducted extensive studies to achieve a toner having not only a low temperature fixing property, but also charging stability and developing stability under a high temperature and high humidity environment; and found that a low molecular weight component causing failure under the high temperature and high humidity environment can be extracted into a mixed solution of water and methanol in a mass ratio of 50:50 (50% by mass aqueous methanol solution). Thus, the present invention has been completed.

Therefore, the toner of the present invention has a soluble component in an amount of 0.10% by mass to 0.60% by mass, more preferably 0.20% by mass to 0.50% by mass where the soluble component is a component soluble in a 50% by mass aqueous methanol solution.

Conventionally, for the purpose of fixing at a low temperature, a binder resin contained in a toner has often been changed to one having a lower molecular weight. As a result, an amount of a component extracted into a 50% by mass aqueous methanol solution (soluble component) is increased to exceed 0.60% by mass. In this case, after storing the toner at a high temperature, the toner has a lower charging amount than before storage. Therefore, the charging amount is disadvantageously changed under the high temperature and high humidity environment.

Meanwhile, the component soluble in a 50% by mass aqueous methanol solution in an amount of less than 0.10% by mass results in poor low temperature fixing property. This is because a component contributing to low temperature fixing is disadvantageously decreased. Although details are unknown, the component is believed to contribute to the low temperature fixing property by increasing affinity for paper through hydrogen bonds between cellulose constituting the paper and carboxyl and hydroxyl groups being rich in the component.

<<Method for Measuring Amount of Component Soluble in 50% by Mass Aqueous Methanol Solution>>

One exemplary method for measuring an amount of a component soluble in a 50% by mass aqueous methanol solution will now be described.

Firstly, methanol is mixed with pure water thoroughly in a mass ratio of 1:1 to thereby obtain a 50% by mass aqueous methanol solution. Then, 1.5 g of a toner is weighed into a 50 mL screw cap vial. The vial is charged with 8.5 g of the 50% by mass aqueous methanol solution, capped, and then gently shaken by hand for about several seconds. Note that, water used for preparing the 50% by mass aqueous methanol solution may be, for example, pure water, but is not particularly limited.

Thereafter, the toner is dispersed with an ultrasonic cleaner (for example, US-1KS, manufactured by SND Co., Ltd.; high frequency output: 60 W, oscillation intensity: 38 Hz) for 30 sec. Then, the screw cap vial containing the resultant toner dispersion liquid is placed into a thermostat bath at 50° C. and allowed to stand for 1.5 hours to thereby allow a soluble component to dissolve, followed by centrifugation to separate the dispersion liquid into solid and liquid phases. The liquid phase alone is placed into another bottle which has been weighed. After drying thoroughly at about 60° C., the bottle is weighed again to thereby calculate a difference from an initial mass of the bottle, which is determined as an amount of the soluble component.

Finally, the value of the amount of the soluble component is divided by the mass of the toner (1.5 g) to thereby determine an amount of the soluble component by percentage.

<Flowing-Out Beginning Temperature (Tfb) of Toner>

The toner of the present invention has the flowing-out beginning temperature (Tfb) of 55.0° C. to 100.0° C. as determined as the flowtester method. The flowing-out beginning temperature (Tfb) is preferably 55.0° C. to 85.0° C., more preferably 55.0° C. to 75.0° C.

The flowing-out beginning temperature (Tfb) of lower than 55.0° C. causes failure related to replenishment of the toner and developing with the toner, making it impossible to achieve good storability. This is because the toner has a reduced softening point to thereby be softened by heat within a device to aggregate. Meanwhile, the flowing-out beginning temperature (Tfb) of higher than 100.0° C. is unsuitable for the low temperature fixing.

<<Method for Measuring Flowing-Out Beginning Temperature (Tfb) of Toner>>

One exemplary method for measuring a flowing-out beginning temperature (Tfb) of the toner will now be described.

An elevated flowtester (SHIMADZU FLOWTESTER CFT-500, manufactured by SHIMADZU CORPORATION) is used. Firstly, 1.0 g of a sample which has been molded with a pressure molding device is extruded from a nozzle (diameter: 0.5 mm, length: 1 mm) at a temperature raising rate of 3.0° C./min and a plunger load of 10 kgf/cm$^3$ to thereby measure a plunger descending amount of the flowtester. The plunger descending amount is plotted against temperature to thereby obtain a plunger descending amount-temperature curve of the flowtester. Based on the curve, a temperature at which the sample begin to flow out can be determined as Tfb. Note that, one exemplary flowing-out curve obtained using an elevated flowtester is illustrated in FIG. 1.

<Amount of Component Insoluble in Ethyl Acetate>

The toner of the present invention preferably contains an insoluble component in an amount of 15% by mass to 30% by mass where the insoluble component is a component insoluble in ethyl acetate. When a binder resin having a lower molecular weight is merely used for the purpose of fixing at the low temperature, a hot offset temperature is also disadvantageously decreased. As a result, the toner is deteriorated in fixing property at a high temperature, rendering it practically unacceptable. Therefore, it is necessary to add a high molecular weight component or a cross-linked resin, or produce a cross-linked component in the toner through a polymerization reaction or a metal complexation reaction.

For the polymerization reaction, a strongly cross-linked component can be obtained through a chemical bond by previously adding a reactive polyester prepolymer and then allowing to proceed an elongation reaction after emulsification and convergence, which is suitable for ensuring a fixing width and for improving storability that is a defect of a low temperature fixing toner.

Generally, a high molecular weight component (e.g., prepolymer) is poor in solubility in a solvent. Therefore, in the present invention, an amount of the high molecular weight component (e.g., prepolymer) can be controlled to thereby allow the amount of the component insoluble in ethyl acetate of the toner to fall within the above described range of 15% by mass to 30% by mass. The amount of the component insoluble in ethyl acetate of the toner falling within the above range can prevent deterioration of the hot offset resistance due to too small amount of the high molecular weight component and deterioration of the low temperature fixing property due to too large amount of the high molecular weight component.

<<Method for Measuring Amount of Component Insoluble in Ethyl Acetate>>

The amount of the component insoluble in ethyl acetate can be calculated as an extraction residue from Soxhlet extraction. One exemplary method is will now be described.

Firstly, 0.5 g of a toner is weighed precisely into a thimble for Soxhlet extraction which has been weighed precisely, 200 g of ethyl acetate is added into a 300 mL flat-bottom flask, and the thimble is placed in a Soxhlet extraction tube. The flat-bottom flask, the Soxhlet extraction tube, and a cooling pipe are coupled to each other. The flat-bottom flask is heated in a mantle heater to thereby perform extraction for 7 hours from the beginning of boiling of the ethyl acetate in the flask. After the extraction, the thimble is washed with ethyl acetate thoroughly, and then the ethyl acetate serving as a solvent is dried thoroughly. The amount of the component insoluble in ethyl acetate contained in the toner can be calculated in percentage from the initial sample weight, the initial thimble weight, and the extraction residue after extraction and drying.

<Toner Composition>

Next, a toner composition of the present invention will now be described along with a method for producing the toner. A method for producing the toner using an emulsion polymerization method will now be described as an example, but the toner of the present invention can be produced using either the emulsion polymerization method or a pulverization method. Therefore, the method for producing the toner is not particularly limited.

The toner of the present invention can be produced by emulsifying or dispersing in an aqueous medium an oil phase in which toner materials (e.g., a binder resin, a release agent, and a colorant) are dissolved or dispersed in an organic solvent and removing the organic solvent.

<<Binder Resin>>

The binder resin is not particularly limited and may be appropriately selected depending on the intended purpose, but preferably contains a polyester resin. The polyester resin will now be described in detail, but other resins than the polyester resin may be used.

The other resins than the polyester resin are not particularly limited and may be appropriately selected depending on the intended purpose. Examples thereof include a styrene-acrylic resin, a polyol resin, a vinyl resin, a polyurethane resin, an epoxy resin, a polyamide resin, a polyimide resin, a silicon resin, a phenolic resin, a melamine resin, a urea resin, an aniline resin, an ionomer resin, and a polycarbonate resin. These may be used alone or in combination.

—Polyester Resin—

The polyester resin is not particularly limited and may be appropriately selected depending on the intended purpose. Examples thereof include a crystalline polyester resin, an unmodified polyester resin, and a polyester prepolymer. Among them, the polyester resin preferably contains the crystalline polyester resin from the viewpoint of an excellent low temperature fixing property.

The binder resin preferably contains the polyester resin in an amount of 50% by mass or more, more preferably 100% by mass.

—Crystalline Polyester Resin—

The crystalline polyester resin contained in toner particles has high crystallinity and thus exhibits a thermal melting property that the viscosity is rapidly decreased in the vicinity of a temperature at which fixing is initiated. That is, use of the crystalline polyester resin can provide a toner having both a good heat resistant storability and a good low temperature fixing property because the crystalline polyester resin has the good heat resistant storability owing to its crystallinity immediately before melting is initiated, but is rapidly decreased in viscosity (sharp melt property) for fixing at a temperature at which melting is initiated.

An amount of the crystalline polyester resin contained in the binder resin is preferably 5% by mass to 30% by mass, more preferably 5% by mass to 15% by mass.

The crystalline polyester resin preferably has a melting point of 55° C. to 80° C., more preferably 58° C. to 70° C. The melting point of lower than 55° C. may deteriorate the heat resistant storability. The melting point of higher than 80° C. may deteriorate the low temperature fixing property.

Note that, in the present invention, the melting point of the crystalline polyester resin refers to the maximum endothermic peak temperature in a differential scanning calorimetry (DSC) curve as determined by a differential scanning calorimeter.

The crystalline polyester resin preferably has a weight average molecular weight (Mw) of 10,000 to 30,000, a number average molecular weight (Mn) of 500 to 6,000, and a ratio of Mw/Mn of 2 to 10 as determined by gel permeation chromatography (GPC) analysis of a component soluble in o-dichlorobenzene.

The weight average molecular weight (Mw) of more than 30,000 may deteriorate the low temperature fixing property. The weight average molecular weight (Mw) of less than 10,000 may deteriorate the heat resistant storability.

The ratio of Mw/Mn of more than 10 causes a molecular weight distribution to be broader, potentially making it difficult to achieve both the low temperature fixing property and the heat resistant storability.

In a molecular weight distribution graph with a horizontal axis expressed in log(M) and a vertical axis expressed in % by mass as determined by the GPC analysis of a component soluble in o-dichlorobenzene, it is preferable that the peak be located in a range of 3.5 to 4.0 and have a half value width of 1.5 or less.

In the present invention, monomer components constituting the crystalline polyester resin are not particularly limited and may be appropriately selected depending on the intended purpose. For example, preferably used are those synthesized from an alcohol component that contains a C2-C20 diol compound or derivatives thereof and an acid component that contains a multivalent carboxylic acid compound (e.g., an aliphatic dicarboxylic acid, an aromatic dicarboxylic acid, and an alicyclic dicarboxylic acid) or derivatives thereof.

Example of the alcohol component includes a C2-C12 saturated aliphatic diol compound. Specific examples thereof include 1,4-butanediol, 1,6-hexanediol, 1,8-octanediol, 1,10-decanediol, 1,12-dodecanediol, and derivatives thereof.

Example of the acid component includes a C2-C12 dicarboxylic acid containing a double bond (C═C bond) or a C2-C12 saturated dicarboxylic acid. Specific examples thereof include fumaric acid, 1,4-butanedioic acid, 1,6-hexanedioic acid, 1,8-octanedioic acid, 1,10-decanedioic acid, 1,12-dodecanedioic acid, and derivatives thereof.

Among them, preferable are those comprised of a C4-C 12 saturated diol component selected from the group consisting of 1,4-butanediol, 1,6-hexanediol, 1,8-octanediol, 1,10-decanediol, and 1,12-dodecanediol and a C4-C 12 saturated dicarboxylic acid component selected from the group consisting of 1,4-butanedioic acid, 1,6-hexanedioic acid, 1,-8-octanedioic acid, 1,10-decanedioic acid, and 1,12-dodecanedioic acid. This is because the thus obtained aliphatic polyester resin has high crystallinity and rapidly changes in viscosity around the melting point.

Generally, the more the crystalline polyester resin is compatibilized with another binder resin, the easier the toner is softened, decreased in the flowing-out beginning temperature, and deteriorated in the heat resistant storability. Therefore, it is important that the crystalline polyester resin is not compatibilized with an unmodified polyester resin during production of the toner. In order to solve this problem, a resin particle dispersion liquid in which the crystalline polyester resin is dispersed in the unmodified polyester can be used to prevent the crystalline polyester resin from compatibilizing with the unmodified polyester resin.

One exemplary method for producing the resin particle dispersion liquid will now be described. The crystalline polyester resin is added alone to an organic solvent, followed by heating to dissolve the crystalline polyester resin. The resultant solution is then cooled to thereby allow the crystalline polyester resin to recrystallize as particles. The unmodified polyester resin is dissolved in the resultant dispersion liquid, followed by finely pulverizing by means of a mechanical pulverizer while keeping a temperature of the dispersion liquid under a temperature at which the crystalline polyester resin is dissolved in the organic solvent. Thus, a resin particle dispersion liquid in which the crystalline polyester resin is not compatibilized with the unmodified polyester can be produced.

In the above method, it is noted that the crystalline polyester resin is not contaminated with the unmodified polyester resin during heating, dissolving, and cooling and that the dispersion liquid is not increased in viscosity and temperature during finely pulverizing by means of the mechanical pulverizer owing to shear applied to the dispersion liquid. Otherwise, the crystalline polyester resin is compatibilized with the unmodified polyester resin, potentially making it impossible to take advantage of sharp meltability of the crystalline polyester resin in the resultant toner.

A dispersion diameter of the crystalline polyester resin in toner particles is preferably 0.1 μm to 2.0 μm, more preferably 0.5 μm to 0.8 μm in a long axis diameter from the viewpoints of fine dispersion of the crystalline polyester resin and uneven distribution on surfaces of the toner particles. When the dispersion diameter is less than 0.1 μm, the crystalline polyester resin dispersion liquid is increased in viscosity, potentially leading to unsuitably controlled diameter distribution. In addition, the crystalline polyester resin tend to easily compatibilize with the unmodified polyester, potentially leading to deterioration of the heat resistant storability. The dispersion diameter of larger than 2.0 μm makes it difficult to granulate the toner.

The dispersion diameter of the crystalline polyester resin may be adjusted, for example, by mechanically pulverizing the resin particle dispersion liquid or by varying a concentration or a cooling rate of a solution used for recrystallization of the crystalline polyester resin.

The organic solvent used for dispersing the crystalline polyester resin is not particularly limited and may be appropriately varied. In particular, preferably used are those can dissolve the crystalline polyester resin completely to thereby form a uniform solution at a high temperature and, when cooling, can precipitate the crystalline polyester resin to thereby form an opaque ununiform solution.

In more detail, based on a temperature (Tm) at which the crystalline polyester resin is dissolved in the organic solvent, preferable organic solvents exhibit a non-solvent property at a temperature less than (Tm−40)° C., but a good-solvent property at a temperature equal to or higher than (Tm−40)° C. Specific examples thereof include toluene, ethyl acetate, butyl acetate, methyl ethyl ketone, and methyl isobutyl ketone. These may be used alone or in combination.

Any commercially available pulverizer may be used as the mechanical pulverizer used for finely pulverizing the crystalline polyester resin precipitated during the cooling. Examples thereof include a bead mill, a ball mill, and a wet pulverizer (ALTIMIZER, manufactured by Sugino Machine Limited).

The toner of the present invention is preferably obtained as follows. A toner material liquid in which toner materials such as the binder resin including the crystalline polyester resin and the unmodified polyester resin, the release agent, and the colorant are dissolved or dispersed; a binder resin precursor; and a compound that undergoes an elongation reaction or a cross-linking reaction with the binder resin precursor are dissolved in an organic solvent to thereby form an oil phase. The resultant oil phase is dispersed in an aqueous medium containing a particle dispersing agent to thereby form an emulsified dispersion liquid.

The binder resin precursor undergoes at least one of the cross-linking reaction and the elongation reaction in the emulsified dispersion liquid. Then, the organic solvent is removed.

In other words, the toner of the present invention is preferably obtained as follows. A compound that undergoes an elongation reaction or a cross-linking reaction with a binder resin precursor is dissolved in an oil phase including a binder resin component, a colorant, and a release agent. The binder resin component contains a binder resin precursor consisting of a crystalline polyester resin, an unmodified polyester resin, and a modified polyester resin. Then, the oil phase in which the compound is dissolved is dispersed in an aqueous medium containing a dispersing agent to thereby obtain a dispersion liquid. The binder resin precursor is reacted with the compound through at least of the cross-linking reaction and the elongation reaction in the dispersion liquid. Then, the organic solvent is removed.

—Unmodified Polyester Resin—

A noncrystalline unmodified polyester resin is preferably an aromatic polyester resin.

An alcohol component used for the unmodified polyester resin may be a dihydric alcohol (diol). Specific examples thereof include C2-C36 alkylene glycol (e.g., ethylene glycol, 1,2-propylene glycol, 1,3-propylene glycol, 1,4-butylene glycol, and 1,6-hexane diol); C4-C36 alkylene ether glycol (e.g., diethylene glycol, triethylene glycol, dipropylene glycol, polyethylene glycol, polypropylene glycol, and polybutylene glycol); C6-C36 alicyclic diol (e.g., 1,4-cyclohexane dimethanol and hydrogenated bisphenol A); adducts of the above listed alicyclic diol with C2-C4 alkylene oxide [e.g., ethylene oxide (hereinafter abbreviated as EO), propylene oxide (hereinafter abbreviated as PO), and butylene oxide (hereinafter abbreviated as BO)] (the number of moles added: 1 to 30); adducts of bisphenols (e.g., bisphenol A, bisphenol F, and bisphenol 5) with C2-C4 alkylene oxide (e.g., EO, PO, and BO) (the number of moles added: 2 to 30).

A trihydric or higher (trihydric to octahydric or higher) alcohol component may be contained in addition to the dihydric alcohol. Specific examples thereof include polyhydric (trihydric to octahydric or higher) C3-C36 aliphatic alcohol (e.g., alkane polyol and intramolecular or intermolecular dehydration product thereof such as glycerin, triethylolethane, trimethylolpropane, pentaerythritol, sorbitol, sorbitan, polyglycerin, and dipentaerythritol; and saccharides and derivatives thereof such as sucrose and methyl glycoside); adducts of the above listed polyhydric aliphatic alcohol with C2-C4 alkylene oxide (e.g., EO, PO, and BO) (the number of moles added: 1 to 30); adducts of trisphenols (e.g., trisphenol PA) with C2-C4 alkylene oxide (e.g., EO, PO, and BO) (the number of moles added: 2 to 30); adducts of a novolac resin (e.g., phenolic novolac and cresol novolac; the average degree of polymerization: 3 to 60) with C2-C4 alkylene oxide (e.g., EO, PO, and BO) (the number of moles added: 2 to 30).

A carboxylic acid component used for the unmodified polyester resin may be divalent carboxylic acid (dicarboxylic acid). Specific examples thereof include C4-C36 alkane dicarboxylic acid (e.g., succinic acid, adipic acid, and sebacic acid) and alkenyl succinic acid (e.g., dodecenylsuccinic acid); C4-C36 alicyclic dicarboxylic acid [e.g., dimer acid (dimerized linoleic acid)]; C4-C36 alkene dicarboxylic acid (e.g., maleic acid, fumaric acid, citraconic acid, and mesaconic acid); and C8-C36 aromatic dicarboxylic acid (e.g., phthalic acid, isophthalic acid, terephthalic acid or derivatives thereof, and naphthalene dicarboxylic acid).

Among them, preferable are C4-C20 alkene dicarboxylic acid and C8-C20 aromatic dicarboxylic acid. Note that, a polycarboxylic acid may be an acid anhydride or a lower alkyl (C1-C4) ester (e.g., methyl ester, ethyl ester, and isopropyl ester) of those above listed.

A trivalent or higher (trivalent to hexavalent or higher) carboxylic acid component may be contained in addition to the divalent carboxylic acid. Specific examples thereof include C9-C20 aromatic polycarboxylic acid (e.g., trimellitic acid and pyromellitic acid); and a vinyl polymer of unsaturated carboxylic acid [number average molecular weight (hereinafter referred to as Mn, determined by gel permeation chromatography (GPC)): 450 to 10,000] (e.g., styrene/maleic acid copolymer, styrene/acrylic acid copolymer, α-olefin/maleic acid copolymer, and styrene/fumaric acid copolymer). Among them, preferable is the C9-C20 aromatic polycarboxylic acid, and particularly preferable are trimellitic acid and pyromellitic acid. Note that, the trivalent or higher polycarboxylic acid may be an acid anhydride or a lower alkyl (C1-C4) ester (e.g., methyl ester, ethyl ester, and isopropyl ester) of those above listed.

In the present invention, the alcohol component is preferably reacted with the carboxylic acid component in a predetermined ratio of OH/COOH, followed by further reacting with benzoic acid in a predetermined amount. This makes it easier to set the amount of the component soluble in a 50% aqueous methanol solution to a desired value. The ratio of OH/COOH and the amount of benzoic acid can be varied appropriately depending on the type or the amount of the alcohol component and the carboxylic acid component, and are not particularly limited. Therefore, it is difficult to define suitable ranges thereof sweepingly. For example, however, when the OH/COOH is 1.293 to 1.364, 10 parts by mass to 29 parts by mass of benzoic acid is preferably added to 600 parts by mass of the total of the alcohol component and the carboxylic acid component to be reacted in the predetermined ratio of OH/COOH.

The unmodified polyester resin has usually an acid value of 1 KOHmg/g to 50 KOHmg/g, preferably 5 KOHmg/g to 30 KOHmg/g. Thus, the acid value of 1 KOHmg/g or more allows the toner to be easily negatively charged. In addition, the toner has better affinity for paper upon fixing, leading to an improved low temperature fixing property. Meanwhile, the acid value of more than 50 KOHmg/g may deteriorate charging stability, especially charging stability against environmental impact. In the present invention, the unmodified polyester resin preferably has the acid value of 1 KOHmg/g to 50 KOHmg/g.

The unmodified polyester resin preferably has a hydroxyl value of 10 KOHmg/g to 30 KOHmg/g. The hydroxyl value is greatly related to the amount of the component soluble in an aqueous methanol solution contained in the toner. The hydroxyl value falling within the preferable range permits the amount of the component soluble in an aqueous methanol solution to be adjusted to the above described appropriate range, and can prevent the toner from absorbing moisture even in the high temperature and high humidity condition.

The hydroxyl value of the unmodified polyester resin of more than 30 KOHmg/g renders the toner susceptible to humidity, so that it becomes difficult to inhibit charging reduction associated with moisture absorption by the toner. Meanwhile, when the hydroxyl value is less than 10 KOHmg/g, the toner tends to have insufficient affinity for cellulose contained in paper serving as a recording medium, resulting in a poor fixing property. The unmodified polyester resin has more preferably the hydroxyl value of 10 KOHmg/g to 20 KOHmg/g.

A method for producing a resin having a low hydroxyl value used in the present invention may be as follows. A terminal polar group of a polyester polymer is blocked and a monofunctional monomer is introduced into the polyester.

The hydroxyl value can be determined by a method according to JIS K0070-1966. One specific example thereof will now be described.

Firstly, 0.5 g of a sample is weighed precisely into a 100 mL volumetric flask, to which 5 mL of an acetylating reagent is added. Next, the volumetric flask is heated in a hot bath of 100±5° C. for 1 to 2 hours. Then, the flask is removed from the hot bath, followed by allowing to cool. The flask is added with water, and shaken to decompose acetic anhydride. Then, the flask is heated again in the hot bath for 10 min or more to thereby decompose acetic anhydride completely, followed by allowing to cool. Thereafter, a wall of the flask is washed well with an organic solvent.

An automatic potentiometric titrator DL-53 TITRATOR (manufactured by Mettler-Toledo International Inc.) and an electrode DG113-SC (manufactured by Mettler-Toledo International Inc.) are used to measure the hydroxyl value at 23° C., followed by analyzing using an analysis software LABX LIGHT Version 1.00.000. Note that, the titrator is calibrated with a mixed solvent of 120 mL of toluene and 30 mL of ethanol.

One exemplary measuring condition is as follows.

| Stir | |
|---|---|
| Speed [%] | 25 |
| Time [s] | 15 |
| EQP titration | |

-continued

| Titrant/Sensor | |
|---|---|
| Titrant | $CH_3ONa$ |
| Concentration [mol/L] | 0.1 |
| Sensor | DG 115 |
| Unit of measurement | mV |
| Predispensing to volume | |
| Volume [mL] | 1.0 |
| Wait time [s] | 0 |
| Titrant addition: Dynamic | |
| dE (set) [mV] | 8.0 |
| dV (min) [mL] | 0.03 |
| dV (max) [mL] | 0.5 |
| Measure mode: Equilibrium controlled | |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs | Yes |
| n = 1 | |
| comb. termination conditions: No | |
| Evaluation | |
| Procedure | Standard |
| Potential 1 | No |
| Potential 2 | No |
| Stop for reevaluation | No |

The unmodified polyester resin preferably has a glass transition temperature Tg of 35° C. to 55° C. The Tg of less than 35° C. deteriorates the storability under the high temperature and high humidity environment, which is likely to cause problems such as solidification, aggregation, and charging reduction due to a change on a surface. Meanwhile, the Tg of more than 55° C. may deteriorate the low temperature fixing property.

<<Prepolymer>>

For the purpose of improving the low temperature fixing property of the toner, what is important is how to impart properties such as the hot offset resistance and the heat resistant storability to the toner. As an example, a prepolymer is suitably used. The prepolymer is preferably a polyester prepolymer modified with isocyanate or epoxy.

As mentioned above, the toner of the present invention has the component insoluble in ethyl acetate in an amount of 15% by mass to 30% by mass. The amount of the component insoluble in ethyl acetate falling within the above range can prevent deterioration of the hot offset resistance due to too small amount of the high molecular weight component and deterioration of the low temperature fixing property due to too large amount of the high molecular weight component.

Generally, a high molecular weight component (e.g., prepolymer) is poor in solubility in a solvent. Therefore, in the present invention, an amount of the high molecular weight component (e.g., prepolymer) can be controlled to thereby allow an amount of the component insoluble in ethyl acetate of the toner to fall within the above described range of 15% by mass to 30% by mass.

The amount of the prepolymer varies depending on the type of polymer, so that it is difficult to define a suitable range sweepingly. However, for example, a polyester prepolymer is preferably contained in the toner in an amount of 5% by mass to 15% by mass.

The polyester prepolymer can be easily synthesized by allowing a polyester resin serving as a base to react with a conventionally known isocyanating agent or epoxidizing agent.

The polyester prepolymer is at least partially compatible with the aforementioned unmodified polyester resin. An alcohol component and a carboxylic acid component contained in the polyester resin serving as the base of the polyester prepolymer preferably has a similar composition to that of the unmodified polyester resin.

The polyester resin serving as the base may be the aforementioned unmodified polyester resin.

Examples of the isocyanating agent include aliphatic polyisocyanate (e.g., tetramethylene diisocyanate, hexamethylene diisocyanate, and 2,6-diisocyanatomethyl caproate); alicyclic polyisocyanate (e.g., isophorone diisocyanate and cyclohexylmethane diisocyanate); aromatic diisocyanate (e.g., tolylene diisocyanate and diphenylmethane diisocyanate); araliphatic diisocyanate (e.g., α,α,α',α'-tetramethyl xylene diisocyanate); isocyanurates; the above listed polyisocyanates blocked with a phenol derivative, oxime, or caprolactam; and combination thereof.

Example of the epoxidizing agent includes epichlorohydrin.

The isocyanating agent is usually used in a ratio of [NCO]/[OH] of 5/1 to 1/1, preferably 4/1 to L2/1, more preferably 2.5/1 to 1.5/1. The ratio of [NCO]/[OH] is an equivalent ratio of an isocyanate group [NCO] to a hydroxyl group [OH] in the polyester serving as the base. The ratio of [NCO]/[OH] of more than 5/1 may deteriorate the low temperature fixing property. A molar ratio of the [NCO] of less than 1 decreases an amount of urea contained in the polyester prepolymer, potentially resulting in deterioration of the hot offset resistance.

An amount of the isocyanating agent contained in the polyester prepolymer is preferably 0.5% by mass to 40% by mass, more preferably 1% by mass to 30% by mass, further preferably 2% by mass to 20% by mass. The amount of less than 0.5% by mass deteriorates the hot offset resistance and is disadvantageous in achieving both the heat resistant storability and the low temperature fixing property. The amount of more than 40% by mass is likely to deteriorate the low temperature fixing property.

The number of the isocyanate group contained per one molecule of the polyester prepolymer is usually 1 or more, preferably 1.5 to 3 on average, further preferably 1.8 to 2.5 on average. When the number is less than 1 per one molecule, a urea-modified polyester resin produced through an elongation reaction has a decreased molecular weight, potentially resulting in deterioration of the hot offset resistance.

The modified polyester preferably has a weight average molecular weight of $5\times10^3$ to $5\times10^4$.

<<Compound that Undergoes Elongation Reaction or Cross-Linking Reaction with Modified Polyester>>

A compound that undergoes an elongation reaction or cross-linking reaction with a modified polyester may be an active-hydrogen group containing compound. Representative example thereof includes amines.

Examples of the amines include a diamine compound, a trivalent or higher polyamine compound, an amino alcohol compound, an amino mercaptan compound, an amino acid compound, and the above listed compounds in which an amino group is blocked.

Examples of the diamine compound include aromatic diamine (e.g., phenylene diamine, diethyltoluene diamine, and 4,4'diaminodiphenyl methane); alicyclic diamine (e.g., 4,4'-diamino-3,3'dimethyldicyclohexyl methane, diamine cyclohexane, and isophoronediamine); and aliphatic diamine (e.g., ethylenediamine, tetramethylene diamine, and hexamethylenediamine).

Examples of the trivalent or higher polyamine compound include diethylene triamine and triethylenetetramine.

Examples of the amino alcohol compound include ethanolamine and hydroxyethylaniline Examples of the amino mercaptan compound include aminoethyl mercaptan and aminopropyl mercaptan.

Examples of the amino acid compound include aminopropionic acid and aminocaproic acid.

Examples of the compounds in which an amino group is blocked include a ketimine compound or an oxazoline compound obtained from any of the above listed amines and ketones (e.g., acetone, methyl ethyl ketone, and methyl isobutyl ketone).

Among them, preferable are the diamine compound, a mixture of the diamine compound with a small amount of the polyamine compound, and a diamine compound in which an amino group is blocked.

Note that, the urea modified polyester resin may be used in combination with a polyester resin modified with a chemical bond other than a urea bond such as a polyester resin modified with a urethane bond, in addition to a noncrystalline unmodified polyester resin.

In the case where the modified polyester resin such as the urea modified polyester resin is contained in an organic solvent, the modified polyester resin can be produced by a one-shot method.

As an example, a method for producing the urea modified polyester resin will now be described.

Firstly, a polyol and a polycarboxylic acid are heated to 150° C. to 280° C. in the presence of a catalyst such as tetrabutoxy titanate or dibutyltin oxide, if necessary, while removing generated water under reduced pressure, to thereby obtain a hydroxyl group containing polyester resin. Next, the hydroxyl group containing polyester resin is reacted with polyisocyanate at 40° C. to 140° C. to thereby obtain an isocyanate group containing polyester prepolymer. The isocyanate group containing polyester prepolymer is reacted with amines at 0° C. to 140° C. to thereby obtain the urea modified polyester resin.

The urea modified polyester resin has usually the number average molecular weight of 1,000 to 10,000, preferably 1,500 to 6,000.

Note that, the reaction of the hydroxyl group containing polyester resin with the polyisocyanate and the reaction of the isocyanate group containing polyester prepolymer with the amines may be, if necessary, performed in a solvent.

Examples of the solvent include those are unreactive with an isocyanate group such as an aromatic solvent (e.g., toluene and xylene); ketones (e.g., acetone, methyl ethyl ketone, and methyl isobutyl ketone); esters (e.g., ethyl acetate); amides (e.g., dimethylformamide and dimethylacetamide); ethers (e.g., tetrahydrofuran).

Note that, an unmodified polyester resin that is produced in the same manner as the hydroxyl group containing polyester resin may be mixed in the solution after reaction of the urea-modified polyester resin.

<<Release Agent>>

The release agent is not particularly limited and may be appropriately selected depending on the intended purpose. Examples thereof include waxes.

Examples of the waxes include a vegetable wax, an animal wax, a mineral wax, and a petroleum wax.

Examples of the vegetable wax include carnauba wax, cotton wax, Japan wax, and rice wax.

Examples of the animal wax include bees wax and lanolin.

Examples of the mineral wax include ozokerite and selsyn.

Examples of the petroleum wax include paraffin, microcrystalline wax, and petrolatum.

Particularly preferable is an ester wax from the viewpoints of a small amount of volatile matter from wax upon fixing, a low possibility of offset upon fixing, the hot offset resistance, and the low temperature fixing property.

The ester wax may be appropriately synthesized or may be commercially available. The ester wax is usually synthesized through an esterification reaction between a long chain fatty acid or a multivalent carboxylic acid and a long chain higher alcohol or a polyhydric alcohol. The long chain fatty acid or the multivalent carboxylic acid and the long chain higher alcohol or the polyhydric alcohol are often from naturally occurring sources. Generally, they are constituted of a mixture containing even-numbered carbon atoms.

The long chain fatty acid is not particularly limited and may be appropriately selected depending on the intended purpose. Examples thereof include myristic acid, palmitic acid, stearic acid, arachidic acid, behenic acid, and lignoceric acid. These may be used alone or in combination.

Examples of the multivalent carboxylic acid include benzene dicarboxylic acids (e.g., phthalic acid, isophthalic acid, and terephthalic acid) or anhydrides thereof; alkyl dicarboxylic acids (e.g., succinic acid, adipic acid, sebacic acid, and azelaic acid) or anhydrides thereof; unsaturated dibasic acids (e.g., maleic acid, citraconic acid, itaconic acid, alkenylsuccinic acid, fumaric acid, and mesaconic acid); anhydrides of unsaturated dibasic acids (e.g., maleic anhydride, citraconic anhydride, it aconic anhydride, and alkenylsuccinic anhydride); trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetrakis(methylene carboxy)methane, 1,2,7,8-octanetetracarboxylic acid, EMPOL trimer acid, and anhydrides or partial lower alkyl esters thereof. These may be used alone or in combination.

The long chain higher alcohol is not particularly limited and may be appropriately selected depending on the intended purpose. Examples thereof include capryl alcohol, capric alcohol, lauryl alcohol, myristyl alcohol, cetyl alcohol, stearyl alcohol, arachidyl alcohol, behenyl alcohol, and lignoceryl alcohol. These may be used alone or in combination.

Examples of the polyhydric alcohol include ethylene glycol, propylene glycol, 1,3-butanediol, 1,4-butanediol, 2,3-butanediol, diethylene glycol, triethyleneglycol, 1,5-pentanediol, 1,6-hexanediol, neopentyl glycol, 2-ethyl-1,3-hexanediol, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene. These may be used alone or in combination.

The esterification reaction is, for example, performed at a temperature of less than 250° C. under normal pressure or reduced pressure preferably in an inert gas such as nitrogen. A reaction ratio of the long chain fatty acid or the multivalent carboxylic acid and the long chain higher alcohol or the polyhydric alcohol is not particularly limited and may be appropriately selected depending on the intended purpose. The esterification reaction may be performed in the presence of a small amount of an esterification catalyst or solvent.

Examples of the esterification catalyst include an organic titanium compound (e.g., tetrabutoxy titanate and tetrapropioxy titanate), an organic tin compound (e.g., dibutyltin dilaurate and dibutyltin oxide), and an organic lead compound.

Examples of the solvent include an aromatic solvent (e.g., toluene, xylene, and mineral spirit).

In the case where the long chain fatty acid or the multivalent carboxylic acid and the long chain higher alcohol or the polyhydric alcohol are esterified without purifying, not only the intended ester compound but also byproducts having various similar structures to the intended ester compound are produced, which is likely to adversely affect properties of the resultant toner.

Therefore, starting materials or reaction products may be purified through extraction with a solvent or distillation under reduced pressure to thereby obtain the ester wax to be used in the present invention.

The release agent preferably has an average particle diameter of 0.2 μm to 2.0 μm in a long axis diameter. The average particle diameter of less than 0.2 μm deteriorates a release effect. The average particle diameter of more than 2.0 μm makes it difficult for the toner to be granulated and causes toner spent with high probability. Therefore, the release agent preferably has the average particle diameter of 0.2 μm to 2.0 μm.

The release agent is contained in the toner in an amount of 1% by mass to 10% by mass.

<<Colorant>>

Known dyes and pigments may be used as a colorant in the present invention. For example, carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), Vulcan fast yellow (5G, B), tartrazine lake, quinoline yellow lake, Anthrasan yellow BGL, isoindolinone yellow, red iron oxide, red lead, lead vermilion, cadmium red, cadmium mercury red, antimony vermilion, permanent red 4R, para red, fiser red, para-chloro ortho-nitro aniline red, Lithol fast scarlet G, brilliant fast scarlet, brilliant carmine BS, permanent red (F2R, F4R, FRL, FRLL and F4RH), fast scarlet VD, Vulcan fast rubin B, brilliant scarlet G, Lithol rubin GX, permanent red FSR, brilliant carmine 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and mixtures thereof may be used.

The colorant is usually contained in the toner in an amount of 1% by mass to 15% by mass, preferably 3% by mass to 10% by mass.

The colorant may be compounded with a binder resin to form a masterbatch.

Examples of the binder resin used for producing the masterbatch or kneaded with the masterbatch include, other than the above mentioned polyester resins, polymers of styrene and substituted styrene (e.g., polystyrene, poly p-chlorostyrene, and polyvinyltoluene); styrene copolymers (e.g., a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer); polymethylmethacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, a polyacrylic resin, rosin, modified rosin, a terpene resin, an aliphatic or alicyclic hydrocarbon resin, an aromatic petroleum resin, chlorinated paraffin, and paraffin wax. These may be used alone or in combination.

The masterbatch can be prepared by mixing and kneading the colorant with the binder resin used for a masterbatch with application of high shearing force. An organic solvent may also be used for enhancing interactions between the colorant and the binder resin. Furthermore, a so-called flushing method is preferably used because a wet cake of the colorant can be used as it is, without the necessity of drying. The flushing method is a method in which an aqueous paste of the colorant is mixed and kneaded with the binder resin and an organic solvent to thereby transfer the colorant to the binder resin, followed by removing water and the organic solvent. For this mixing and kneading, a high-shearing disperser (e.g., a three-roll mill) is preferably used.

<<Charging Control Agent>>

The toner of the present invention may contain a charging control agent, if necessary. Known charging control agents may be used.

Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples of the charging control agent include nigrosine dye BONTRON 03, quaternary ammonium salt BONTRON P-51, metal-containing azo dye BONTRON S-34, oxynaphthoic acid metal complex E-82, salicylic acid metal complex E-84 and phenol condensate E-89 (manufactured by ORIENT CHEMICAL INDUSTRIES CO., LTD); quaternary ammonium salt molybdenum complexes TP-302 and TP-415 (manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036, and COPY CHARGE NX VP434 (manufactured by Clariant Inc.); LRA-901 and boron complex LR-147 (manufactured by Japan Carlit Co., Ltd.); copper phthalocyanine, perylene, quinacridone, azo pigments, and polymeric compounds containing a functional group (e.g., a sulfonate group, a carboxyl group, or a quaternary ammonium salt).

An amount of the charging control agent contained in the toner is determined based on the type of the binder resin, the presence or absence of optionally used additive(s), and the toner production methods including dispersion methods, and it is not unambiguously determined. However, the amount is preferably 0.1 parts by mass to 10 parts by mass, more preferably 0.2 parts by mass to 5 parts by mass relative to 100 parts by mass of the binder resin. When the amount is greater than 10 parts by mass, the chargeability of the toner is so large that a main charge controlling agent exhibits reduced effects, and electrostatic attractive force between the toner and a developing roller increases, leading to decreased flowability of a developer and reduced image density.

The charging control agent may be melt-kneaded with the masterbatch and the binder resin and then dissolved or dispersed in the organic solvent, or, of course, may be directly added to the organic solvent to thereby be dissolved or dispersed therein, or may be fixed on surfaces of the formed toner particles.

<<External Additive>>

The toner of the present invention may contain an external additive for providing toner particles with flowability, developability, chargeabilityor cleanability. The external additive capable of providing toner particles, with flowability, developability, or chargeability is preferably inorganic particles.

Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride.

Each of the inorganic particles preferably has a primary particle diameter of 5 nm to 2 μm (2,000 nm), more preferably 5 nm to 500 nm.

Each of the inorganic particles preferably has specific surface area of 20 $m^2/g$ to 500 $m^2/g$ as determined by a BET method.

The inorganic particles are preferably contained in the toner in an amount of 0.01% by mass to 5% by mass, more preferably 0.01% by mass to 2.0% by mass.

Other examples of the inorganic particles include polymeric particles of polystyrene, methacrylic ester or an acrylic ester copolymer each of which is produced through soap-free emulsion polymerization, suspension polymerization, or dispersion polymerization; polycondensated particles of silicone, benzoguanamine, or nylon; and polymeric particles of a thermosetting resin.

The external additive capable of providing toner particles with flowability may be surface-treated with a surface treating agent for increasing hydrophobicity to thereby prevent the toner particle from being deteriorated in the flowability and the chargeability even under high humidity.

Examples of the surface treating agent include a silane coupling agent, a silylating agent, a silane coupling agent containing a fluorinated alkyl group, an organotitanate coupling agent, an aluminum coupling agent, silicone oil, and modified silicone oil.

Meanwhile, the external additive of providing toner particles with cleanability, that is, a cleanability improving agent for removing a developing agent remaining after transfer on an electrostatic latent image bearer (photoconductor) or a primary transfer medium includes a metal salt of fatty acid such as stearic acid (e.g., zinc stearate and calcium stearate); and polymeric particles produced through soap-free emulsion polymerization (e.g., polymethylmethacrylate particles and polystyrene particles).

The polymer particles have a relatively narrow particle diameter distribution, and has preferably the volume average particle diameter of 0.01 μm to 1 μm.

<<Particle Diameter of Toner>>

The toner of the present invention preferably has the volume average particle diameter of 3 μm to 7 μm and a ratio of the volume average particle diameter to the number average particle diameter of 1.2 or less. The volume average particle diameter of less than 3 μm may cause toner scatter. The volume average particle diameter of more than 7 μm may deteriorate thin line reproducibility.

The toner preferably contain a component having the particle diameter of 2 μm or less in an amount of 10% by number.

The volume average particle diameter (Dv) and the number average particle diameter (Dn) of the toner of the present invention can be determined by, for example, measuring with a granulometer ("MULTISIZER II", manufactured by Beckman Coulter, Inc.) at an aperture diameter of 100 μm and then analyzing with an analyzing software (Beckman Coulter Mutlisizer 3 Version3.51). Specifically, 0.5 mL of a 10% by mass surfactant (alkylbenzene sulfonate NEOGEN SC-A, manufactured by DKS Co. Ltd.) is added to a 100 mL glass beaker. Then, 0.5 g of the toner is added thereto, followed by stirring with a microspartel, and then adding with 80 mL of ion exchanged water. The thus obtained dispersion liquid was dispersed with an ultrasonic disperser (W-113MK-II, manufactured by HONDA ELECTRONICS CO., LTD.) for 10 min.

Next, the dispersion liquid is measured using the MULTISIZER III and ISOTON III (manufactured by Beckman Coulter, Inc.) as a solution for measurement. The dispersion liquid of toner sample is added dropwise so that a concentration thereof indicated by the MULTISIZER III is 8±2%. In this measurement, it is important to control the concentration of the dispersion liquid of toner sample to 8±2% from the viewpoint of measurement reproducibility of the particle diameter. The concentration falling within the above range is less likely to cause error with respect to particle diameter.

(Developing Agent)

A developing agent used in the present invention may be a one-component developing agent or a two-component developing agent containing, for example, a carrier. The toner of the present invention may be a one-component magnetic or nonmagnetic toner without the carrier.

In the case where the toner of the present invention is used in the two-component developing agent, the toner may be mixed with a magnetic carrier and a mass ratio of the carrier to the toner contained in the developing agent is preferably 1 part by mass to 10 parts by mass of the toner relative to 100 parts by mass of the carrier.

The magnetic carrier may be conventionally known. For example, iron powder, ferrite powder, magnetite powder, and magnetic resin carrier having the particle diameter of 20 μm to 200 μm may be used.

In addition, a resin-coated carrier in which magnetic particles such as iron or ferrite are coated with a coating material such as resin, or a binder carrier in which magnetic powder is dispersed in a binder resin may be used.

Examples of the coating material include an amino resin such as a urea-formaldehyde resin, a melamine resin, a benzoguanamine resin, a urea resin, and a polyamide resin.

The following resins may be used:

polyvinyl and polyvinylidene resin, acrylic resin, polymethyl methacrylate resin, polyacrylonitrile resin, polyvinyl acetate resin, polyvinyl alcohol resin, and polyvinyl butyral resin, polystyrene-based resin such as polystyrene resin and styrene-acrylic copolymer resin, halogenated olefin resin such as polyvinyl chloride, polyester resin such as polyethylene terephthalate resin and polybutylene terephthalate resin, polycarbonate resin and polyethylene resin, polyvinyl fluoride resin, polyvinylidene fluoride resin, polytrifluoroethylene resin, polyhexafluoropropylene resin, a copolymer of vinylidene fluoride and acrylic monomer, a copolymer of vinylidene fluoride and vinyl fluoride, a fluoroterpolymer such as a terpolymer of tetrafluoroethylene, vinylidene fluoride, and nonfluorinated monomer, silicone resin, and epoxy resin.

Conductive powder may be contained in the resin for coating, if necessary. Examples of the conductive powder include metal powder, carbon black, titanium oxide, tin oxide, and zinc oxide. The conductive powder preferably has an average particle diameter of 1 μm or less. The average particle diameter of more than 1 μm makes it difficult to control electric resistance.

(Image Forming Apparatus)

An image forming apparatus of the present invention includes an electrostatic latent image bearer; a charging unit configured to charge a surface of the electrostatic latent image bearer; an exposure unit configured to expose the thus charged surface of the electrostatic latent image bearer to light to thereby form an electrostatic latent image; a developing unit configured to develop the electrostatic latent image with a toner to thereby form a visible image; a transfer unit configured to transfer the visible image onto a recording medium; and a fixing unit configured to fix the image transferred onto the recording medium. The developing unit contains the toner and uses the toner. The image forming apparatus of the present invention more preferably includes a cleaning unit in addition to the above listed units; and, if necessary, may further include at least one of a charge-eliminating unit, a recycle unit, and a controlling unit. Note that, the image forming apparatus preferably has a process linear velocity of 300 mm/s to 1,500 mm/s.

In the present invention, the image forming apparatus of the present invention may be used to perform an image forming method. An electrostatic latent image forming unit may be used to perform an electrostatic latent image forming step; the developing unit may be used to perform a developing step; the transfer unit may be used to perform a transfer step; the fixing unit may be used to perform a fixing step; and other units may be used to perform other steps.

The electrostatic latent image forming step is a step of forming an electrostatic latent image on the electrostatic latent image bearer such as a photoconductive insulator and a photoconductor. Materials, shapes, structures or sizes of the electrostatic latent image bearer are not particularly limited and may be appropriately selected from known ones, but the electrostatic latent image bearer is preferably drum-shaped. The photoconductor includes an inorganic photoconductor (e.g., amorphous silicon and selenium) and an organic photoconductor (e.g., polysilane and phthalopolymethine) Among them, an amorphous silicon photoconductor is preferable from the viewpoint of longer operating life.

The electrostatic latent image may be formed, for example, by uniformly charging a surface of the electrostatic latent image bearer, and then exposing it imagewise to light, and may be formed with the electrostatic latent image forming unit. The electrostatic latent image forming unit includes a charger configured to apply voltage to a surface of the electrostatic latent image bearer to thereby uniformly charge the surface, and an exposure device configured to expose the surface of the electrostatic latent image bearer imagewise to light.

The charger is not particularly limited. For example, known contact chargers equipped with a conductive or semi-conductive roller, a brush, a film, or a rubber blade and non-contact chargers employing corona discharge (e.g., corotron and scorotron) may be used The exposure device is not particularly limited as long as it can expose the surface of the electrostatic latent image bearer which has been charged by the charger imagewise to light. Examples of the exposure device include various exposure devices such as a copy optical system, a rod lens array system, a laser optical system, and a liquid crystal shutter optical system. Note that, a back-exposure method may be employed in which the electrostatic latent image bearer is exposed imagewise to light from the back side.

The developing step is a step of developing the electrostatic latent image with the developing agent to thereby form a toner image. The visible image may be formed with the developing unit.

The developing unit is not particularly limited as long as it can develop an image with the toner of the present invention. For example, a developing unit including a developing device which contains the toner of the present invention and which can apply the toner to the electrostatic latent image in a contact or non-contact manner may be used.

The developing device may employ a dry or wet developing process, and may be a single-color or multi-color developing device. For example, the developing device may have a rotatable magnetic roller and a stirrer for charging the developing agent with friction generated during stirring. In the developing device, toner particles and carrier particles are stirred and mixed so that the toner particles are charged by friction generated therebetween. The charged toner particles are retained in the chain-like form on a surface of the rotating magnetic roller to thereby form magnetic brushes. The magnetic roller is disposed adjacent to the electrostatic latent image bearer and thus, some of the toner particles constituting the magnetic brushes on the magnet roller are transferred onto the surface of the electrostatic latent image bearer by the action of electrically attractive force. As a result, the electrostatic latent image is developed with the toner to thereby form a toner image on the surface of the electrostatic latent image bearer.

The transfer step is a step of charging the electrostatic latent image bearer on which the toner image is formed to thereby transfer the toner image onto a recording medium; and may be performed using the transfer unit. The transfer step preferably includes a primary transfer step in which the toner image is transferred onto an intermediate transfer member, and a secondary transfer step in which the toner image on the intermediate transfer member is transferred onto the recording medium. The transfer step more preferably includes a primary transfer step in which toner images of each color of toners of two or more colors, preferably, a full color toner are transferred onto the intermediate transfer member to thereby form a composite toner image and a secondary transfer step in which the composite toner image on the intermediate transfer member onto the recording medium.

The transfer unit preferably has a primary transfer unit configured to transfer the toner image onto the intermediate transfer medium to thereby form a composite toner image and a secondary transfer unit configured to transfer the composite toner image on the intermediate transfer medium onto the recording medium. Note that, the intermediate transfer medium is not particularly limited, but may be an endless transfer belt. The transfer unit (primary transfer unit and secondary transfer unit) preferably includes a transfer device configured to transfer the toner image on the electrostatic latent image bearer to the recording medium via stripping charging. The transfer unit may include one or two or more transfer devices.

Examples of the transfer device include a corona transfer device employing corona discharge, a transfer belt, a transfer roller, a pressing transfer roller, and an adhesive transfer device.

Note that, the recording medium is not particularly limited and may be appropriately selected from known recording media (recording paper).

The fixing step is a step of fixing the toner image on the recording medium, and may be performed using the fixing unit. In the case of using toners of two or more colors, the fixing step may be performed every after a toner image of each color is transferred onto the recording medium; or the fixing step may be performed at one time after toner images of all colors are transferred on top of one another on the recording medium. The fixing unit is not particularly limited and may employ a thermal fixing method using a known heating-pressing unit. Examples of the heating-pressing unit include a combination of a heating roller and a pressing roller; and a combination of a heating roller, a pressing roller and an endless belt. The heating temperature is preferably 80° C. to 200° C. Note that, a known optical fixing unit may be used along with the fixing unit, if necessary.

Conventionally, in the thermal fixing method, half or more of the total power consumed by the image forming apparatus is used for heating the toner in the fixing device employing the thermal fixing method. However, there is a desire for an image forming apparatus consuming lower power (energy saving) from the viewpoint of countermeasures against environmental problems in recent years.

For example, the DSM (demand-side Management) program of International Energy Agency (TEA) in the 1999 fiscal year includes a technology procurement project of the next-generation copiers and describes their requirement specification, where copiers with 30 cpm or higher is required for remarkable energy saving as compared with the conventional copiers. Specifically, these copiers have to have a waiting time of 10 sec or shorter during which the consumption power is set to 10 Watt to 30 Watt (which is varied with the copying speed). Therefore, energy saving must be achieved in the fixing unit which consumes high consumption power.

One essential technical matter to be achieved in order to meet the above requirement and shorten the waiting time is to decrease a temperature at which the toner begins to melt, thereby reducing the fixing temperature during use. Use of the toner of the present invention in the image forming apparatus of the present invention is effective for decreasing the fixing temperature.

The fixing unit has been being improved for energy saving. Among the thermal fixing methods, a thermal roller fixing method in which a heating roller is pressed directly against the toner image on the recording medium for fixing has widely been employed because of good thermal efficiency. In another employable method, a heating roller is made to have low thermal capacity, thereby improving the response of the toner to the temperature. However, the lowered specific thermal capacity of the heating roller results in a greater difference in temperature between portions through which the recording medium has passed and portions through which the recording medium has not passed, causing adhesion of the toner to a fixing roller. As a result, after the fixing roller has been rotated once, so-called hot offset phenomenon occurs where the toner is fixed on non-image portions of the recording medium. Thus, there are stricter requirements on the toner for the hot offset resistance as well as the low temperature fixing property. Therefore, the toner of the present invention being excellent in both the low temperature fixing property and the hot offset resistance is effectively used.

A charge-eliminating step is the step of applying a charge-eliminating bias to the electrostatic latent image bearer to eliminate charges thereof, and may be performed by the charge-eliminating unit. The charge-eliminating unit is not particularly limited as long as it can apply the charge-eliminating bias to the electrostatic latent image bearer. For example, a charge-eliminating lamp may be used.

A cleaning step is step of removing residual toner on the electrostatic latent image bearer, and may be performed by the cleaning unit. The cleaning unit is not particularly limited as long as it can remove residual toner on the electrostatic latent image bearer. Examples thereof include a magnetic brush cleaner, an electrostatic brush cleaner, a magnetic roller cleaner, a blade cleaner, a brush cleaner, and a web cleaner.

The recycle step is a step of recycling the toner which has been removed in the cleaning step to the developing unit, and may be performed by the recycle unit. The recycle unit is not particularly limited and may be known conveying units.

A controlling step is a step of controlling each of the above steps, and may be performed by the controlling unit. The controlling unit is not particularly limited as long as it can control the operation of each of the above units. Examples thereof include a sequencer and a computer.

Figure 2:
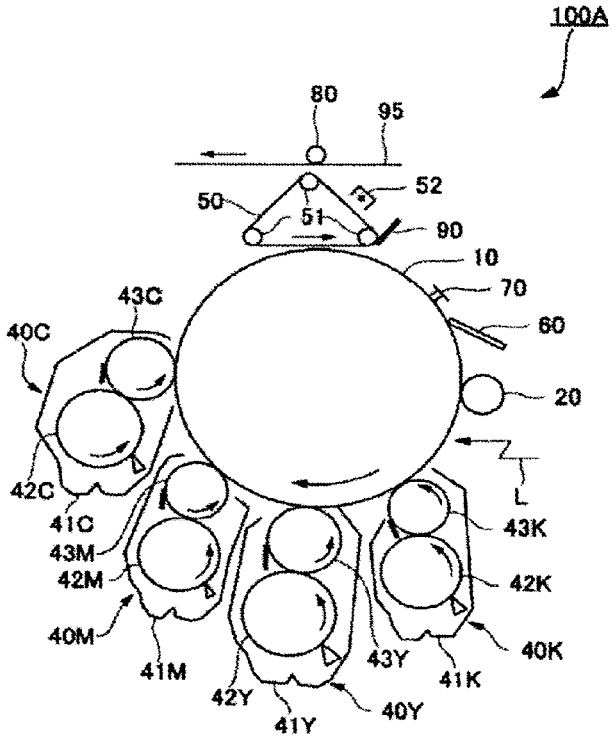
FIG. 2 is a schematic view illustrating one exemplary image forming apparatus according to the present invention.

FIG. 2 illustrates one exemplary image forming apparatus according to the present invention. An image forming apparatus 100A includes a photoconductor drum 10 serving as the electrostatic latent image bearer, a charging roller 20 serving as the charging unit, an exposure device serving as the exposing unit, a developing device 40 serving as the developing unit, an intermediate transfer member 50, a cleaning device 60 having a cleaning blade serving as the cleaning unit, a charge-eliminating lamp 70 serving as the charge-eliminating unit, and a fixing device serving as the fixing unit.

The intermediate transfer member 50 is an endless belt and can be moved in a direction indicated by the arrow with being stretched by three rollers 51 which are disposed in a loop of the belt. Some of the three rollers 51 serve also as a transfer bias roller capable of applying a predetermined transfer bias (primary transfer bias) to the intermediate transfer member 50. The cleaning device 60 having a cleaning blade is disposed adjacent to the intermediate transfer member 50. Also, a transfer roller 80 is disposed so as to face the intermediate transfer member 50 and serves as a transfer unit capable of applying a transfer bias for transferring (secondarily transferring) a toner image onto a sheet of recording paper 95. Around the intermediate transfer member 50, a corona charger 52 configured to apply charges to the toner image on the intermediate transfer member 50 is disposed between a contact portion of the photoconductor drum 10 with the intermediate transfer member 50 and a contact portion of the intermediate transfer member 50 with the sheet of recording paper 95.

The developing devices 40 for black (K), yellow (Y), magenta (M) and cyan (C) toners each contain a developing agent accommodating section 41, a developing agent feeding roller 42, and a developing roller 43. The fixing device includes a heating roller and a pressing roller.

In the image forming apparatus 100A, the charging roller 20 uniformly charges the photoconductor drum 10. Then, the exposure device exposes the thus charged photoconductor drum 10 imagewise to light L to thereby form an electrostatic latent image. The electrostatic latent image formed on the photoconductor drum 10 is developed with a developing agent supplied from each of the developing devices 40 to thereby form a toner image. The toner image is transferred (primarily transferred) onto the intermediate transfer member 50 with a transfer bias applied from the rollers 51. The toner image transferred onto the intermediate transfer member 50 is charged with the corona charger 52 and then is transferred (secondarily transferred) onto the sheet of recording paper 95. The toner image on the sheet of recording paper 95 is heated and pressed by the heating roller and the pressing roller of the fixing device, so that the toner image is melted and fixed on the sheet of recording paper 95. Meanwhile, residual toner on the photoconductor drum 10 is removed by the cleaning device 60, and the charges on the photoconductor drum 10 are eliminated by the charge-eliminating lamp 70.

Figure 3:
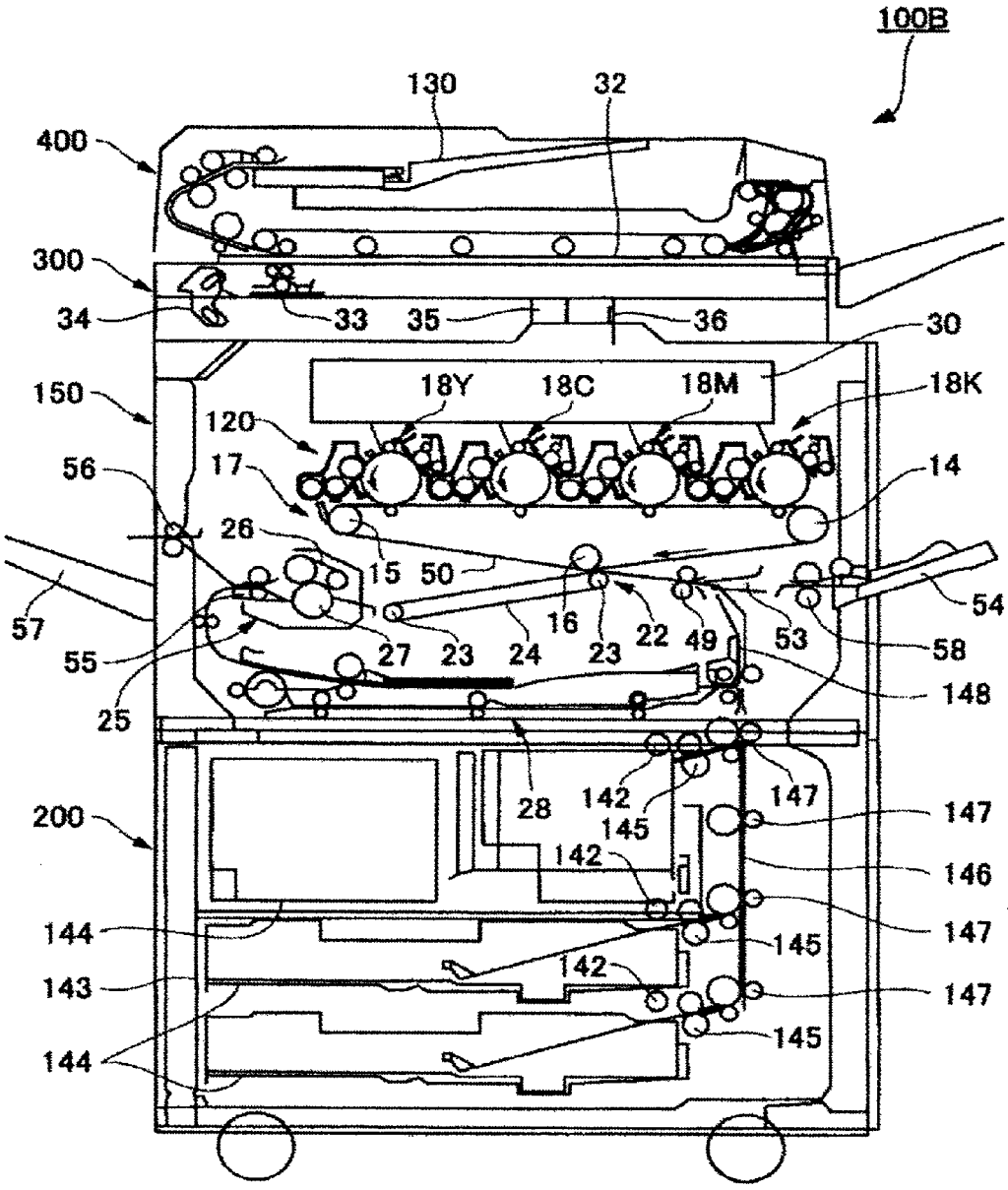
FIG. 3 is a schematic view illustrating another exemplary image forming apparatus according to the present invention.

FIG. 3 illustrates another exemplary image forming apparatus according to the present invention. An image forming apparatus 100B is a tandem color image forming apparatus and includes a copying machine main body 150, a sheet feeding table 200, a scanner 300, and an automatic document feeder (ADF) 400.

The copying device main body 150 is provided at its center portion with an endless belt-form intermediate transfer member 50. The intermediate transfer member 50 can be rotated with being stretched by support rollers 14, 15 and 16 in a direction indicated by the arrow. A cleaning device 17 configured to remove residual toner on the intermediate transfer member 50 is disposed adjacent to the support roller 15. Around the intermediate transfer member 50 stretched by the support rollers 14 and 15 is provided a tandem developing device 120 in which four image forming units 18 for yellow, cyan, magenta, and black toners are arranged in a row along the moving direction of the intermediate transfer member.

Figure 4:
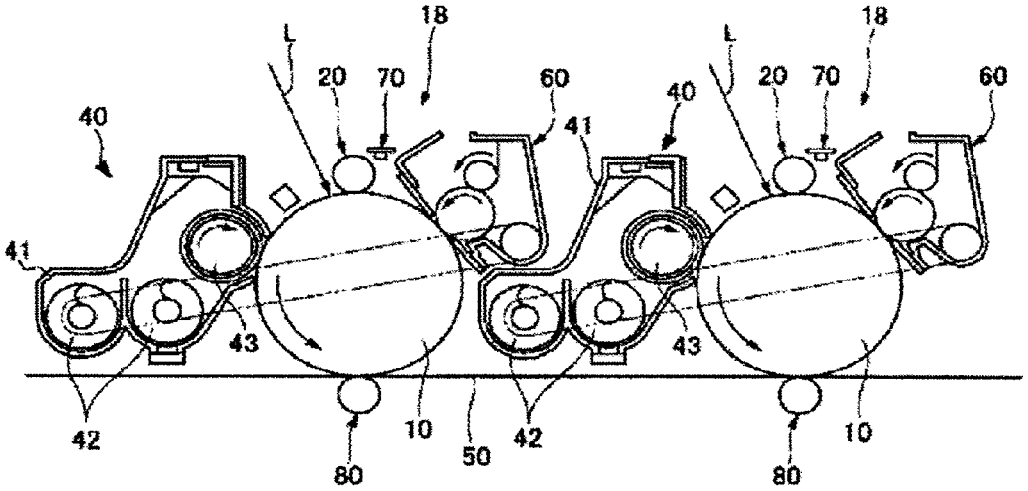
FIG. 4 is a schematic view illustrating one exemplary image forming unit.

As illustrated in FIG. 4, each of the image forming units 18 includes a photoconductor drum 10; a charging roller 20 configured to uniformly charge the photoconductor drum 10; a developing device 40 configured to develop an electrostatic latent image formed on the photoconductor drum 10 with a developing agent of black (K), yellow (Y), magenta (M), or cyan (C) to thereby form a toner image; a transfer roller 80 configured to transfer the toner image onto an intermediate transfer member 50; a cleaning device 60; and a charge-eliminating lamp 70.

In addition, an exposure device 30 is disposed adjacent to the tandem developing device 120. The exposure device 30 exposes the photoconductor drum 10 to light L to thereby form an electrostatic latent image.

In FIG. 4, the reference number 41 denotes a developing agent accommodating section, the reference number 42 denotes a developing agent feeding roller 42, and the reference number 43 denotes a developing roller.

Also, a secondary transfer unit 22 is disposed on the intermediate transfer member 50 on the side opposite to the side where the tandem developing device 120 is disposed. The secondary transfer device 22 includes an endless belt-form secondary transfer belt 24 and a pair of rollers 23 stretching the secondary transfer belt. The sheet of recording paper conveyed on the secondary transfer belt 24 can come into contact with the intermediate transfer member 50.

A fixing device 25 is disposed adjacent to the secondary transfer unit 22. The fixing device 25 includes an endless-form fixing belt 26 and a pressing roller 27 disposed so as to be pressed against the fixing belt 26. One of the rollers stretching the fixing belt 26 is a heating roller. Also, a sheet-reversing device 28 configured to reverse a sheet of recording paper is disposed adjacent to the secondary transfer device 22 and the fixing device 25 and is used for forming an image on both sides of the sheet of recording paper.

Next will be described formation of a full color image (color copy) using the image forming apparatus 100B having the above-described configuration. First, an original document is set on a document table 130 of the automatic document feeder (ADF) 400. Alternatively, the automatic document feeder 400 is opened, an original document is set on a contact glass 32 of the scanner 300, and then the automatic document feeder 400 is closed. In the former case, when a starting switch is pressed, the original document is conveyed to the contact glass 32 and then the scanner 300 is operated to run a first carriage 33 and a second carriage 34. In the latter case, when a starting switch is pressed, the scanner 300 is immediately operated to run a first carriage 33 and a second carriage 34. At that time, the first carriage 33 irradiates the original document with light from a light source, and then the second carriage 34 reflects, on its mirror, light reflected by the original document. The thus-reflected light is received by a reading sensor 36 through an imaging lens 35. Thus, the original document (color image) is read to thereby obtain image information corresponding to black, yellow, magenta and cyan.

Furthermore, based on the thus-obtained image information, an electrostatic latent image corresponding to each color is formed on the photoconductor drum 10 with the exposure device 30. Subsequently, the electrostatic latent image is developed with a developing agent supplied from the developing device 40 for each color toner, to thereby form color toner images. The thus-formed color toner images are sequentially transferred (primarily transferred) on top of one another on the intermediate transfer member 50 which is being rotated by the support rollers 14, 15 and 16. Thus, a composite toner image is formed on the intermediate transfer member 50.

In the sheet feeding table 200, one of sheet feeding rollers 142 is selectively rotated to feed sheets of recording paper from one of vertically stacked sheet feeding cassettes 144 housed in a paper bank 143. The thus-fed sheets are separated from one another by a separating roller 145. The thus-separated sheet is fed through a sheet feeding path 146, then guided to a sheet feeding path 148 in the copying device main body 150 by a transfer roller 147, and stopped at a registration roller 49. Alternatively, sheets of recording paper placed on a manual feed tray 54 are fed, and the thus-fed sheets are separated from one another by a separating roller 58. The thus-separated sheet is fed through a manual sheet feeding path 53, and stopped at the registration roller 49. Note that, the registration roller 49 is generally grounded in use, but it may be used while a bias is being applied thereto for removing paper dust from the recording paper.

The registration roller 49 is rotated to feed a sheet of recording paper between the intermediate transfer member 50 and the secondary transfer unit 22 so that the composite toner image formed on the intermediate transfer member 50 can be transferred (secondarily transferred) onto the sheet of recording paper.

The sheet of recording paper on which the composite toner image is formed is fed by the secondary transfer unit 22 to the fixing device 25. In the fixing device 25, the composite toner image is fixed on the sheet of recording paper with the fixing belt 26 and the pressing roller 27 through application of heat and pressure.

Subsequently, the sheet of recording paper is discharged from a discharge roller 56 by a switching claw 55 and then stacked on a discharge tray 57. Alternatively, the sheet of recording paper is reversed with the sheet-reversing unit 28 by a switching claw 55 and conveyed again to a position where transfer is performed. Thereafter, an image is also formed on the back surface of the sheet, and then the sheet is discharged from the discharge roller 56 and stacked on the discharge tray 57.

Note that, after the composite toner image is transferred, a cleaning device 17 removes the residual toner on the intermediate transfer member 50.

Figure 5:
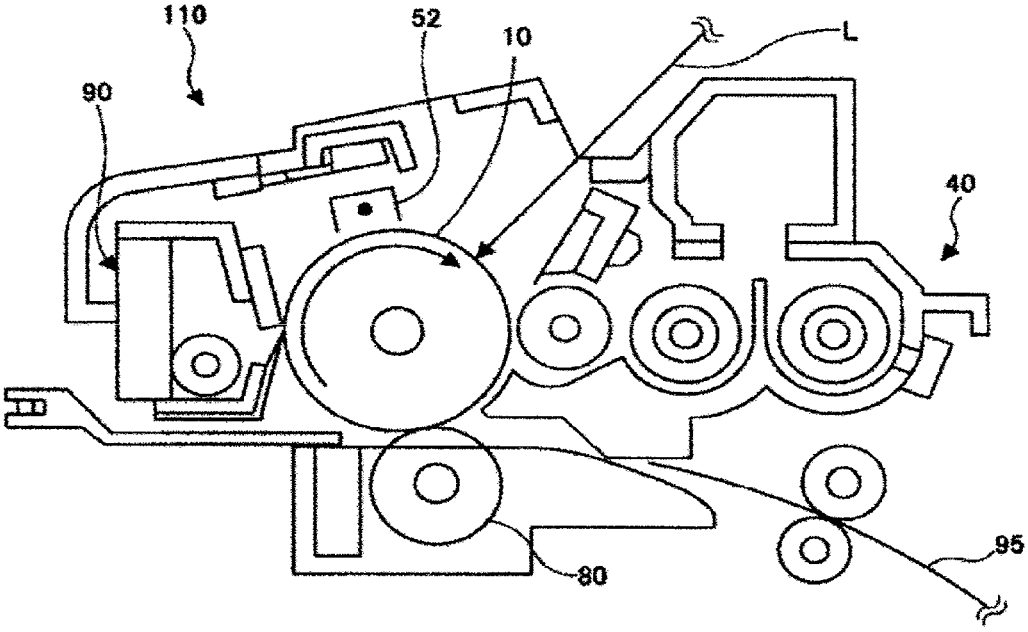
FIG. 5 is a schematic view illustrating one exemplary process cartridge according to the present invention.

FIG. 5 illustrates one exemplary process cartridge according to the present invention. A process cartridge 110 includes a photoconductor drum 10, a corona charger 52, a developing device 40, a transfer roller 80 and a cleaning device 90. In FIG. 5, the reference number 95 denotes a sheet of recording paper.

The process cartridge according to the present invention includes an electrostatic latent image bearer and a developing unit containing a toner of the present invention and configured to develop an electrostatic latent image on the electrostatic latent image bearer with the toner, which are supported in an integrated state. The process cartridge is detachably mounted to a main body of the image forming apparatus. The process cartridge may further includes other units, if necessary.

The developing unit includes a developing agent accommodating container configured to accommodate a developing agent, and a developing agent bearer configured to bear and convey the developing agent accommodated in the developing agent accommodating container. Note that, the developing unit may further include a regulating member configured to regulate the thickness of the developing agent to be borne.

EXAMPLES

The present invention will now be described in more detail referring to Examples, but the present invention is not limited to the following Examples. Note that, "%" denotes "% by mass" and "part(s)" denotes "part(s) by mass" in Examples.

Example 1

—Synthesis of Polyester Resin 1—

A reaction container equipped with a nitrogen introducing pipe, a dehydrating pipe, a stirrer, and a thermocouple was charged with 376 parts of bisphenol A propylene oxide 2 mol adduct and 109 parts of bisphenol A propylene oxide 3 mol adduct at a molar ratio of 80/20 (bisphenol A propylene oxide 2 mol adduct/bisphenol A propylene oxide 3 mol adduct), and 116 parts of isophthalic acid and 44 parts of adipic acid at a molar ratio of 70/30 (isophthalic acid/adipic acid) with OH/COOH=1.364 (molar ratio in terms of functional groups), and then allowed to react together in the presence of 500 ppm of titanium tetraisopropoxide at 230° C. under normal pressure for 10 hours. Then, 16 parts of benzoic acid was added to the reaction container, following by allowing to react under reduced pressure of 10 mmHg to 15 mmHg for 5 hours. Thereafter, 11 parts of trimellitic anhydride was added to the reaction container, following by allowing to react at 180° C. under normal pressure for 3 hours to thereby obtain noncrystalline [Polyester resin 1].

—Preparation of Aqueous Phase—

Nine hundred and ninety parts of water, 83 parts of the [Polyester resin1], 37 parts of a 48.5% aqueous solution of sodium dodecyl diphenyl ether disulfonate (ELEMINOL MON-7; manufactured by Sanyo Chemical Industries, Ltd.), and 90 parts of ethyl acetate were mixed together and stirred to thereby obtain an opaque white liquid, which was determined as [Aqueous phase 1].

—Synthesis of Crystalline Resin—

A reaction vessel equipped with a cooling pipe, a stirrer, and a nitrogen introducing pipe was charged with 241 parts of sebacic acid, 55 parts of adipic acid, 314 parts of 1,4-butanediol, and 0.75 parts of titanium dihydroxy bis (triethanol aminate) as a condensation catalyst, and then allowed to react at 180° C. under a nitrogen stream for 4 hours with generated water being distilled off. Then, while gradually heating to 225° C., the resultant was allowed to react for 3 hours under the nitrogen stream with generated water and 1,4-butanediol being distilled off, followed by further allowing to react under reduced pressure of 5 mmHg to 20 mmHg until a weight average molecular weight (Mw) thereof reached about 1,200 to thereby obtain [Crystalline resin'].

Then, 218 parts of the resultant [Crystalline resin'] was transferred into a reaction vessel equipped with a cooling pipe, a stirrer, and a nitrogen introducing pipe. To the vessel, were added 250 parts of ethyl acetate, 40 parts of hexamethylene diisocyanate (HDI), and 25 parts of maleic anhydride, followed by allowing to react under the nitrogen stream at 80° C. for 5 hours and distilling off ethyl acetate under reduced pressure to thereby obtain [Crystalline resin].

—Synthesis of Polyester Prepolymer—

A reaction container equipped with a cooling pipe, a stirrer, and a nitrogen introducing pipe was charged with 682 parts of bisphenol A ethylene oxide 2 mol adduct, 81 parts of bisphenol A propylene oxide 2 mol adduct, 283 parts of terephthalic acid, 22 parts of trimellitic anhydride, and 2 parts of dibutyl tin oxide, followed by allowing to reacting under normal pressure at 230° C. for 8 hours and under reduced pressure of 10 mmHg to 15 mmHg for 5 hours to thereby obtain [Intermediate polyester]. The [Intermediate polyester] was found to have the number average molecular weight of 2,100, the weight average molecular weight of 9.500, the Tg of 55° C., the acid value of 0.5, and the hydroxyl value of 51.

Then, a reaction container equipped with a cooling pipe, a stirrer, and a nitrogen introducing pipe was charged with 410 parts of the [Intermediate polyester], 89 parts of isophorone diisocyanate, and 500 parts of ethyl acetate, followed by allowing to react at 100° C. for 5 hours to thereby obtain [Polyester prepolymer].

—Synthesis of Ketimine Compound (Active Hydrogen Group Containing Compound)—

A reaction container equipped with a stirrer bar and a thermometer was charged with 170 parts of isophorone diamine and 75 parts of methyl ethyl ketone, followed by allowing to react at 50° C. for 5 hours to thereby synthesize [Ketimine compound] (active hydrogen group containing compound). The resultant [Ketimine compound] was found to have the amine value of 418.

—Production of Masterbatch—

One hundred parts of [Polyester resin 1] and 100 parts of a cyan pigment (C. I. Pigment blue 15:3) were mixed with a Henschel mixer (manufactured by NIPPON COKE & ENGINEERING CO., LTD.) at 1,000 rpm for 5 min, followed by kneading with an open roll kneader (manufactured by NIPPON COKE & ENGINEERING CO., LTD.) and pulverized with a rotoplex mill to thereby produce pigment dispersion powder (size: 2 mm), which was determined as [Masterbatch].

—Production of Wax Dispersion Liquid—

A reaction vessel was charged with 20 parts of carnauba wax, 80 parts of the [Polyester resin 1], and 120 parts of ethyl acetate, followed by heating to 78° C. to be dissolved well, and cooling to 30° C. in 1 hour with stirring. Then, the resultant was heated to 40° C. and subjected to wet pulverization with an ultra visco mill (manufactured by Aimex Corporation) at a liquid delivering rate of 1.0 Kg/hr, at a disk peripheral velocity of 10 m/sec, with zirconia beads having a diameter of 0.5 mm packed to 80% by volume, for 6 passes to thereby produce [Wax dispersion liquid].

—Production of Toner 1—

A vessel equipped with a thermometer and a stirrer was charged with 20 parts of [Crystalline resin] and 24 parts of ethyl acetate, following by heating to a temperature equal to or higher than the melting point of the resin to be dissolved well. To this, were added 102 parts of a 50% solution of the [Polyester resin 1] in ethyl acetate, 66 parts of the [Wax dispersion liquid], 10 parts of the [Masterbatch], 12 parts of [Polyester prepolymer], and 0.20 parts of the [Ketimine compound], followed by stirring at 50° C. with a TK homomixer (manufactured by Primix Corporation) at the number of revolutions of 10,000 rpm to be dissolved and dissolved uniformly, to thereby obtain [Oil phase 1].

Next, 50 parts of the [Oil phase 1] retained at 20° C. was added to 70 parts of the [Water phase 1], followed by mixing with the TK homomixer (manufactured by Primix Corporation) at the number of revolutions of 13,000 rpm for 1 min. The resultant mixed solution was subjected to desolvation under reduced pressure atmosphere until a concentration of ethyl acetate in the solution was 0.1% by mass or less, to thereby obtain [Composite particle slurry 1].

Then, 100 pars of the resultant [Composite particle slurry 1] of toner base particles was filtered at reduced pressure to thereby obtain a filtration cake. The filtration cake was subjected to the following washing steps (1) to (4).

(1) 100 parts of ion exchanged water was added to the filtration cake, and they were mixed with the TK homomixer (at the number of revolutions of 6,000 rpm for 5 min) and then filtered to thereby obtain a filtration cake.

(2) 100 parts of a 10% aqueous sodium hydroxide solution was added to the filtration cake of (1), and they were mixed with the TK homomixer (at the number of revolutions of 6,000 rpm for 10 min) and then filtered under reduced pressure to thereby obtain a filtration cake.

(3) 100 parts of 10% hydrochloric acid was added to the filtration cake of (2), and they were mixed with the TK homomixer (at the number of revolutions of 6,000 rpm for 5 min) and then filtered to thereby obtain a filtration cake.

(4) 300 parts of ion exchanged water to the filtration cake of (3), and they were mixed with the TK homomixer (at the number of revolutions of 6,000 rpm for 5 min) and then filtered. This procedure was repeated twice, to thereby obtain [Filtration cake 1].

The resultant [Filtration cake 1] was dried with an air-circulating drier at 40° C. for 48 hours. Thereafter, the resultant was sieved through a 75 μm mesh, to thereby produce [Toner base particles 1].

The resultant toner base particles were subjected to an external addition treatment. Specifically, 100 parts of the [Toner base particles 1] was mixed with 1.0 part of hydrophobic silica (average particle diameter: 80 nm), 0.5 parts of titanium oxide (average particle diameter: 20 nm), and 1.3 parts of hydrophobic silica powder (average particle diameter: 25 nm) with a Henschel mixer (manufactured by NIPPON COKE & ENGINEERING CO., LTD.) at a low speed (peripheral velocity: 20 m/sec) for 1 min. One minute after, the resultant was mixed at a high speed (peripheral velocity: 35 m/sec) for 12 min to thereby obtain [Toner 1].

Example 2

—Production of Toner 2—

[Polyester resin 2] was obtained in the same manner as in Example 1, except that, in the Synthesis of [Polyester resin 1], the amount of benzoic acid was changed from 16 parts to 29 parts.

[Toner 2] was obtained in the same manner as in Example 1, except that, in the Production of Toner 1, the [Polyester resin 1] was changed to the [Polyester resin 2].

Example 3

—Production of Toner 3—

[Polyester resin 3] was obtained in the same manner as in Example 1, except that, in the Synthesis of [Polyester resin 1], the value of OH/COOH was adjusted to 1.330.

[Toner 3] was obtained in the same manner as in Example 1, except that, in the Production of Toner 1, the [Polyester resin 1] was changed to the [Polyester resin 3].

Example 4

—Production of Toner 4—

[Polyester resin 4] was obtained in the same manner as in Example 1, except that, in the Synthesis of [Polyester resin 1], the amount of benzoic acid was changed from 16 parts to 29 parts, and the value of OH/COOH was adjusted to 1.330.

[Toner 4] was obtained in the same manner as in Example 1, except that, in the Production of Toner 1, the [Polyester resin 1] was changed to the [Polyester resin 4].

Example 5

—Production of Toner 5—

[Polyester resin 5] was obtained in the same manner as in Example 1, except that, in the Synthesis of [Polyester resin 1], the value of OH/COOH was adjusted to 1.324.

[Toner 5] was obtained in the same manner as in Example 1, except that, in the Production of Toner 1, the [Polyester resin 1] was changed to the [Polyester resin 5].

Example 6

—Production of Toner 6—

[Polyester resin 6] was obtained in the same manner as in Example 1, except that, in the Synthesis of [Polyester resin 1], the amount of benzoic acid was changed from 16 parts to 29 parts, and the value of OH/COOH was adjusted to 1.324.

[Toner 6] was obtained in the same manner as in Example 1, except that, in the Production of Toner 1, the [Polyester resin 1] was changed to the [Polyester resin 6].

Example 7

—Production of Toner 7—

[Polyester resin 7] was obtained in the same manner as in Example 1, except that, in the Synthesis of [Polyester resin 1], the value of OH/COOH was adjusted to 1.312.

[Toner 7] was obtained in the same manner as in Example 1, except that, in the Production of Toner 1, the [Polyester resin 1] was changed to the [Polyester resin 7].

Example 8

—Production of Toner 8—

[Polyester resin 8] was obtained in the same manner as in Example 1, except that, in the Synthesis of [Polyester resin 1], the amount of benzoic acid was changed from 16 parts to 29 parts, and the value of OH/COOH was adjusted to 1.312.

[Toner 8] was obtained in the same manner as in Example 1, except that, in the Production of Toner 1, the [Polyester resin 1] was changed to the [Polyester resin 8].

Example 9

—Production of Toner 9

[Polyester resin 9] was obtained in the same manner as in Example 1, except that, in the Synthesis of [Polyester resin 1], the value of OH/COOH was adjusted to 1.310.

[Toner 9] was obtained in the same manner as in Example 1, except that, in the Production of Toner 1, the [Polyester resin 1] was changed to the [Polyester resin 9].

Example 10

—Production of Toner 10—

[Polyester resin 10] was obtained in the same manner as in Example 1, except that, in the Synthesis of [Polyester resin 1], the amount of benzoic acid was changed from 16 parts to 29 parts, and the value of OH/COOH was adjusted to 1.310.

[Toner 10] was obtained in the same manner as in Example 1, except that, in the Production of Toner 1, the [Polyester resin 1] was changed to the [Polyester resin 10].

Example 11

—Production of Toner 11—

[Polyester resin 11] was obtained in the same manner as in Example 1, except that, in the Synthesis of [Polyester resin 1], the value of OH/COOH was adjusted to 1.293.

[Toner 11] was obtained in the same manner as in Example 1, except that, in the Production of Toner 1, the [Polyester resin 1] was changed to the [Polyester resin 11].

Example 12

—Production of Toner 12—

[Polyester resin 12] was obtained in the same manner as in Example 1, except that, in the Synthesis of [Polyester resin 1], the amount of benzoic acid was changed from 16 parts to 29 parts, and the value of OH/COOH was adjusted to 1.293.

[Toner 12] was obtained in the same manner as in Example 1, except that, in the Production of Toner 1, the [Polyester resin 1] was changed to the [Polyester resin 12].

Example 13

—Production of Toner 13—

[Polyester resin 13] was obtained in the same manner as in Example 1, except that, in the Synthesis of [Polyester resin 1], the amount of benzoic acid was changed from 16 parts to 26 parts, and the value of OH/COOH was adjusted to 1.345.

[Toner 13] was obtained in the same manner as in Example 1, except that the [Oil phase 1] was changed to the below produced [Oil phase 13].

—Production of Oil phase 13—

A vessel was charged with 19 parts of [Crystalline resin] and 24 parts of ethyl acetate, following by heating to a temperature equal to or higher than the melting point of the resin to be dissolved well. To this, were added 100 parts of a 50% solution of the [Polyester resin 13] in ethyl acetate, 66 parts of the [Wax dispersion liquid], 10 parts of the [Masterbatch], 14 parts of the [Polyester prepolymer], and 0.23 parts of the [Ketimine compound]. They were stirred at 50° C. with the TK homomixer (manufactured by Primix Corporation) at the number of revolutions of 10,000 rpm to be dissolved and dissolved uniformly, to thereby obtain [Oil phase 13].

Example 14

[Toner 14] was obtained in the same manner as in Example 1, except that the [Oil phase 1] was changed to the below produced [Oil o phase 14].

—Production of Oil Phase 14—

A vessel was charged with 21 parts of [Crystalline resin] and 24 parts of ethyl acetate, following by heating to a temperature equal to or higher than the melting point of the resin to be dissolved well. To this, were added 108 parts of a 50% solution of the [Polyester resin 13] in ethyl acetate, 66 parts of the [Wax dispersion liquid], 10 parts of the [Masterbatch], 8 parts of the [Polyester prepolymer], and 0.13 parts of the [Ketimine compound]. They were stirred at 50° C. with the TK homomixer (manufactured by Primix Corporation) at the number of revolutions of 10,000 rpm to be dissolved and dissolved uniformly, to thereby obtain [Oil phase 14].

Example 15

[Toner 15] was obtained in the same manner as in Example 1, except that the [Oil phase 1] was changed to the below produced [Oil phase 15].

—Production of Oil Phase 15—

A vessel was charged with 19 parts of [Crystalline resin] and 24 parts of ethyl acetate, following by heating to a temperature equal to or higher than the melting point of the resin to be dissolved well. To this, were added 96 parts of a 50% solution of the [Polyester resin 13] in ethyl acetate, 66 parts of the [Wax dispersion liquid], 10 parts of the [Masterbatch], 16 parts of the [Polyester prepolymer], and 0.27 parts of the [Ketimine compound]. They were stirred at 50° C. with the TK homomixer (manufactured by Primix Corporation) at the number of revolutions of 10,000 rpm to be dissolved and dissolved uniformly, to thereby obtain [Oil phase 15].

Example 16

[Toner 16] was obtained in the same manner as in Example 1, except that the [Oil phase 1] was changed to the below produced [Oil phase 16].

—Production of Oil Phase 16—

A vessel was charged with 21 parts of [Crystalline resin] and 24 parts of ethyl acetate, following by heating to a temperature equal to or higher than the melting point of the resin to be dissolved well. To this, were added 110 parts of a 50% solution of the [Polyester resin 13] in ethyl acetate, 66 parts of the [Wax dispersion liquid], 10 parts of the [Masterbatch], 7 parts of the [Polyester prepolymer], and 0.12 parts of the [Ketimine compound]. They were stirred at 50° C. with the TK homomixer (manufactured by Primix Corporation) at the number of revolutions of 10,000 rpm to be dissolved and dissolved uniformly, to thereby obtain [Oil phase 16].

Example 17

[Toner 17] was obtained in the same manner as in Example 1, except that the [Oil phase 1] was changed to the below produced [Oil phase 17].

—Production of Oil Phase 17—

A vessel was charged with 23 parts of [Crystalline resin] and 24 parts of ethyl acetate, following by heating to a temperature equal to or higher than the melting point of the resin to be dissolved well. To this, were added 120 parts of a 50% solution of the [Polyester resin 13] in ethyl acetate, 66 parts of the [Wax dispersion liquid], and 10 parts of the [Masterbatch]. They were stirred at 50° C. with the TK homomixer (manufactured by Primix Corporation) at the number of revolutions of 10,000 rpm to be dissolved and dissolved uniformly, to thereby obtain [Oil phase 17].

Example 18

[Toner 18] was produced by an emulsion aggregation method as follows.

—Production of Polyester Resin Dispersion Liquid—

Sixty parts of ethyl acetate was added to 60 parts of the [Polyester resin 13] to be dissolved to thereby obtain [Resin solution]. Then, 120 parts of water, 2 parts of an anionic surfactant (NEOGEN R, manufactured by DKS Co. Ltd.), and 2.4 parts of a 2% by mass aqueous sodium hydroxide solution were mixed together to thereby obtain [Water phase 18]. To 160 parts of the [Water phase 18], was added 120 parts of the [Resin solution]. The resultant was emulsified by means of a homogenizer (ULTRA-TURRAX T50, manufactured by IKA), followed by subjecting to emulsification by means of Manton-Gaulin high pressure homogenizer (manufactured by SPX Corporation), to thereby obtain [Emulsified Slurry A].

Subsequently, a container equipped with a stirrer and a thermometer was charged with the [Emulsified Slurry A], followed by desolventizing at 30° C. for 4 hours, to thereby obtain [Polyester resin dispersion liquid A]. The resultant [Polyester resin dispersion liquid A] was found to have the volume average particle diameter of 0.15 μm as determined by a particle diameter distribution measuring device (LA-920, manufactured by HORIBA, Ltd.).

—Preparation of Release Agent Dispersion Liquid A—

Twenty five parts of carnauba wax, 1 part of the anionic surfactant (NEOGEN R, manufactured by DKS Co. Ltd.), and 200 parts of water were mixed together and melted at 90° C. The resultant melted liquid was emulsified by means of the homogenizer (ULTRA-TURRAX T50, manufactured by IKA), followed by subjecting to emulsification by means of Manton-Gaulin high-pressure homogenizer (manufactured by SPX Corporation), to thereby obtain [Release agent dispersion liquid A].

—Preparation of Colorant Dispersion Liquid A—

Twenty parts of a cyan pigment (C. I. Pigment blue 15:3), 0.5 parts of the anionic surfactant (NEOGEN R, manufactured by DKS Co. Ltd.), and 80 parts of water were mixed together to be dispersed by the TK homomixer (manufactured by Primix Corporation) to thereby obtain [Colorant dispersion liquid A].

—Aggregation—

A container equipped with a thermometer and a stirrer was charged with 292 parts of the [Polyester resin dispersion liquid A], 45 parts of the [Release agent dispersion liquid A], 34 parts of the [Colorant dispersion liquid A], and 600 parts of water, followed by stirring at 30° C. for 30 min. A 2% by mass aqueous sodium hydroxide solution was added to the resultant dispersion liquid to thereby adjust to a pH of 10. To the dispersion liquid, was gradually added dropwise 50 parts of a 5% by mass aqueous magnesium chloride solution while heating to 45° C. and stirring with the homogenizer (ULTRA-TURRAX T50, manufactured by IKA) at 5,000 rpm. The resultant was kept at 45° C. until aggregated particles therein have the volume average particle diameter of 5.1 μm. To this, was added a 2% by mass aqueous sodium hydroxide solution, followed by heating to 90° C. while keeping at pH 9, holding at the same temperature for 2 hours, and cooling to 20° C. at the rate of 1° C./min to thereby form toner particles. The resultant particle dispersion liquid was subjected to desolvation in the same manner as in Example 1 to thereby obtain [Composite particle slurry 18]. This was subjected to washing, drying, and the external addition treatment in the same manner as in Example 1 to thereby obtain [Toner 18].

Example 19

[Toner 19] was produced by a pulverization method as follows.

—Production of Toner 19—

After premixing 72 parts of the [Polyester resin 13], 6 parts of carnauba wax, and 12 parts of [Masterbatch] with a Henschel mixer (HENSCHEL 20B; manufactured by NIPPON COKE & ENGINEERING CO., LTD.) at 1,500 rpm for 3 min, the resultant mixture was melt-kneaded with a single screw kneader (compact type Buss ko-kneader, manufactured by Buss AG) under the following conditions: an inlet temperature of 90° C., an outlet temperature of 60° C., and a feed amount of 10 kg/hr. The resultant kneaded product was rolled and cooled, followed by coarsely pulverized with a pulverizer (manufactured by Hosokawa Micron Corporation). Then, the resultant roughly pulverized product was finely pulverized with an I-type mill (IDS-2; manufactured by Nippon Pneumatic Mfg. Co., Ltd.) by making the roughly pulverized product directly crash into a flat crashing board under the following conditions: air pressure of 6.0 atm/cm$^2$ and a feed amount of 0.5 kg/hr. The resultant finely pulverized product was classified with a classifier (132MP; manufactured by Hosokawa Alpine AG.) to thereby obtain [Toner base particles 19], which was then subjected to the external addition treatment in the same manner as in Example 1 to thereby obtain [Toner 19].

Comparative Example 1

—Production of Toner 20—

[Polyester resin 20] was obtained in the same manner as in Example 1, except that, in the Synthesis of [Polyester resin 1], the value of OH/COOH was adjusted to 1.290.

[Toner 20] was obtained in the same manner as in Example 1, except that, in the Production of Toner 1, the [Polyester resin 1] was changed to the [Polyester resin 20].

Comparative Example 2

—Production of Toner 21—

[Polyester resin 21] was obtained in the same manner as in Example 1, except that, in the Synthesis of [Polyester resin 1], the amount of benzoic acid was changed from 16 parts to 9 parts, and the value of OH/COOH was adjusted to 1.295.

[Toner 21] was obtained in the same manner as in Example 1, except that, in the Production of Toner 1, the [Polyester resin 1] was changed to the [Polyester resin 21].

Comparative Example 3

—Production of Toner 22—

[Polyester resin 22] was obtained in the same manner as in Example 1, except that, in the Synthesis of [Polyester resin 1], the amount of benzoic acid was changed from 16 parts to 29 parts, and the value of OH/COOH was adjusted to 1.291.

[Toner 22] was obtained in the same manner as in Example 1, except that, in the Production of Toner 1, the [Polyester resin 1] was changed to the [Polyester resin 22].

Comparative Example 4

—Production of Toner 23—

[Polyester resin 23] was obtained in the same manner as in Example 1, except that, in the Synthesis of [Polyester resin 1], the amount of benzoic acid was changed from 16 parts to 30 parts, and the value of OH/COOH was adjusted to 1.293.

[Toner 23] was obtained in the same manner as in Example 1, except that, in the Production of Toner 1, the [Polyester resin 1] was changed to the [Polyester resin 23].

Comparative Example 5

—Production of Toner 24—

[Polyester resin 24] was obtained in the same manner as in Example 1, except that, in the Synthesis of [Polyester resin 1], the amount of benzoic acid was changed from 16 parts to 9 parts, and the value of OH/COOH was adjusted to 1.317.

[Toner 24] was obtained in the same manner as in Example 1, except that, in the Production of Toner 1, the [Polyester resin 1] was changed to the [Polyester resin 24].

Comparative Example 6

—Production of Toner 25—

[Polyester resin 25] was obtained in the same manner as in Example 1, except that, in the Synthesis of [Polyester resin 1], the amount is of benzoic acid was changed from 16 parts to 30 parts, and the value of OH/COOH was adjusted to 1.317.

[Toner 25] was obtained in the same manner as in Example 1, except that, in the Production of Toner 1, the [Polyester resin 1] was changed to the [Polyester resin 25].

Comparative Example 7

—Production of Toner 26—

[Polyester resin 26] was obtained in the same manner as in Example 1, except that, in the Synthesis of [Polyester resin 1], the value of OH/COOH was adjusted to 1.367.

[Toner 26] was obtained in the same manner as in Example 1, except that, in the Production of Toner 1, the [Polyester resin 1] was changed to the [Polyester resin 26].

Comparative Example 8

—Production of Toner 27—

[Polyester resin 27] was obtained in the same manner as in Example 1, except that, in the Synthesis of [Polyester resin 1], the amount of benzoic acid was changed from 16 parts to 9 parts.

[Toner 27] was obtained in the same manner as in Example 1, except that, in the Production of Toner 1, the [Polyester resin 1] was changed to the [Polyester resin 27].

Comparative Example 9

—Production of Toner 28—

[Polyester resin 28] was obtained in the same manner as in Example 1, except that, in the Synthesis of [Polyester resin 1], the amount of benzoic acid was changed from 16 parts to 29 parts, and the value of OH/COOH was adjusted to 1.367.

[Toner 28] was obtained in the same manner as in Example 1, except that, in the Production of Toner 1, the [Polyester resin 1] was changed to the [Polyester resin 28].

Comparative Example 10

—Production of Toner 29—

[Polyester resin 29] was obtained in the same manner as in Example 1, except that, in the Synthesis of [Polyester resin 1], the amount of benzoic acid was changed from 16 parts to 30 parts.

[Toner 29] was obtained in the same manner as in Example 1, except that, in the Production of Toner 1, the [Polyester resin 1] was changed to the [Polyester resin 29].

(Measurement)

The toners obtained in the above described Examples and Comparative Examples were subjected to the following measurements.

<<Method for Measuring Amount of Component Soluble in 50% by Mass Aqueous Methanol Solution>>

Firstly, methanol was mixed with pure water thoroughly in a mass ratio of 1:1 to thereby obtain a 50% by mass aqueous methanol solution. Then, 1.5 g of a toner was weighed into a 50 mL screw cap vial. The vial was charged with 8.5 g of the 50% by mass aqueous methanol solution, capped, and then gently shaken by hand for about several seconds. Thereafter, the toner was dispersed with an ultrasonic cleaner (US-1KS, manufactured by SND Co., Ltd.; high frequency output: 60 W, oscillation intensity: 38 Hz) for 30 sec. Then, the screw cap vial containing the resultant toner dispersion liquid was placed into a thermostat bath at 50° C. and allowed to stand for 1.5 hours to thereby allow a soluble component to dissolve, followed by centrifugation to separate the dispersion liquid into solid and liquid phases. The liquid phase alone was placed into another bottle which had been weighed. After drying thoroughly at about 60° C., the bottle was weighed again to thereby calculate a difference from an initial mass of the bottle, which was determined as an amount of the soluble component. Finally, the value of the amount of the soluble component was divided by the mass of the toner (1.5 g) to thereby determine the amount of the soluble component by percentage.

<<Method for Measuring Flowing-Out Beginning Temperature (Tfb) of Toner>>

An elevated flowtester (SHIMADZU FLOWTESTER CFT-500, manufactured by SHIMADZU CORPORATION) was used. Firstly, 1.0 g of a sample which had been molded with a pressure molding device was extruded from a nozzle (diameter: 0.5 mm, length: 1 mm) at a temperature raising rate of 3.0° C./min and a plunger load of 10 kgf/cm$^3$ to thereby measure a plunger descending amount of the flowtester. The plunger descending amount was plotted against temperature to thereby obtain a plunger descending amount-temperature curve of the flowtester. Based on the curve, a temperature at which the sample began to flow out was determined as Tfb.

<<Method for Measuring Amount of Component Insoluble in Ethyl Acetate>>

Firstly, 0.5 g of a toner was weighed precisely into a thimble for Soxhlet extraction which had been weighed precisely, 200 g of ethyl acetate was added into a 300 mL flat-bottom flask, and the thimble was placed in a Soxhlet extraction tube. The flat-bottom flask, the Soxhlet extraction tube, and a cooling pipe were coupled to each other. The flat-bottom flask was heated in a mantle heater to thereby perform extraction for 7 hours from the beginning of boiling of the ethyl acetate in the flask. After the extraction, the thimble was washed with ethyl acetate thoroughly, and then the ethyl acetate serving as a solvent was dried thoroughly. An amount of a component insoluble in ethyl acetate contained in the toner was calculated in percentage from the initial sample weight, the initial thimble weight, and the extraction residue after extraction and drying.

Results are presented in the following Table 1 along with values of OH/COOH in the polyester resins and added amounts of benzoic acid.

TABLE 1

| | Polyester resin | | | Amount of component soluble in | Amount of component insoluble |
|---|---|---|---|---|---|
| | OH/COOH | Benzoic acid (part(s)) | Flowtester Tfb (° C.) | aqueous methanol solution (%) | in ethyl acetate (%) |
| Ex. 1 | 1.364 | 16 | 56.5 | 0.55 | 25 |
| Ex. 2 | 1.364 | 29 | 56.0 | 0.14 | 24 |
| Ex. 3 | 1.330 | 16 | 73.7 | 0.57 | 25 |
| Ex. 4 | 1.330 | 29 | 74.2 | 0.13 | 27 |
| Ex. 5 | 1.324 | 16 | 76.0 | 0.56 | 24 |
| Ex. 6 | 1.324 | 29 | 75.8 | 0.15 | 23 |
| Ex. 7 | 1.312 | 16 | 83.9 | 0.57 | 27 |
| Ex. 8 | 1.312 | 29 | 84.3 | 0.13 | 26 |
| Ex. 9 | 1.310 | 16 | 86.2 | 0.55 | 22 |
| Ex. 10 | 1.310 | 29 | 86.0 | 0.14 | 24 |
| Ex. 11 | 1.293 | 16 | 98.9 | 0.57 | 26 |
| Ex. 12 | 1.293 | 29 | 99.2 | 0.13 | 24 |
| Ex. 13 | 1.345 | 26 | 65.6 | 0.30 | 28 |
| Ex. 14 | 1.345 | 26 | 64.6 | 0.34 | 16 |
| Ex. 15 | 1.345 | 26 | 66.2 | 0.34 | 32 |
| Ex. 16 | 1.345 | 26 | 64.3 | 0.33 | 13 |
| Ex. 17 | 1.345 | 26 | 65.1 | 0.36 | 4 |
| Ex. 18 | — | — | 65.4 | 0.34 | 5 |
| Ex. 19 | — | — | 66.0 | 0.35 | 3 |
| Comp. Ex. 1 | 1.290 | 16 | 102.0 | 0.55 | 26 |
| Comp. Ex. 2 | 1.295 | 9 | 98.3 | 0.64 | 24 |
| Comp. Ex. 3 | 1.291 | 29 | 101.5 | 0.12 | 23 |
| Comp. Ex. 4 | 1.293 | 30 | 99.1 | 0.07 | 25 |
| Comp. Ex. 5 | 1.317 | 9 | 81.2 | 0.63 | 23 |
| Comp. Ex. 6 | 1.317 | 30 | 79.7 | 0.07 | 24 |
| Comp. Ex. 7 | 1.367 | 16 | 54.1 | 0.56 | 22 |
| Comp. Ex. 8 | 1.364 | 9 | 55.6 | 0.63 | 24 |
| Comp. Ex. 9 | 1.367 | 29 | 53.8 | 0.13 | 25 |

TABLE 1-continued

| | Polyester resin | | | Amount of component soluble in | Amount of component insoluble |
|---|---|---|---|---|---|
| | OH/COOH | Benzoic acid (part(s)) | Flowtester Tfb (° C.) | aqueous methanol solution (%) | in ethyl acetate (%) |
| Comp. Ex. 10 | 1.364 | 30 | 55.4 | 0.07 | 24 |

Toners obtained in Examples and Comparative Examples were evaluated as follows.

<Fixing Lower Limit Temperature>

A copier MF2200 (manufactured by Ricoh Company, Ltd.) of which fixing portion had been modified by using a TEFRON (registered trademark) roller as a fixing roller was used to determine a cold offset occurrence temperature (fixing lower limit temperature). Specifically, printing was performed at varying fixing temperatures on TYPE 6200 paper (manufactured by Ricoh Company, Ltd.) with a toner deposition amount at 20 mm apart from the upper end being adjusted to 0.80 mg/cm$^2$.

Evaluation conditions of the fixing lower limit temperature were as follows: linear velocity of sheet feeding: 120 mm/sec to 150 mm/sec; surface pressure: 1.2 kgf/cm$^2$; and nip width: 3 mm. Meanwhile, evaluation conditions of the fixing upper limit temperature were as follows: linear velocity of sheet feeding: 50 mm/sec; surface pressure: 2.0 kgf/cm$^2$; and nip width: 4.5 mm.

The fixing lower limit temperature is preferably low because of reduced energy consumption. The fixing lower limit temperature of 130° C. or less is practically acceptable.

Evaluation criteria are as follows:

A: Fixing lower limit temperature was lower than 123° C.

B: Fixing lower limit temperature was 123° C. or more but less than 125° C.

C: Fixing lower limit temperature was 125° C. to 130° C.

D: Fixing lower limit temperature was higher than 130° C.

<Fixing Upper Limit Temperature>

A fixing upper limit temperature was evaluated in the same manner as the fixing lower limit temperature, except that the toner deposition amount was adjusted to 0.40 mg/cm$^2$. A hot offset occurrence temperature (fixing upper limit temperature) was determined in the same manner as the fixing lower limit temperature, except that the fixing temperatures were increased. A fixing member is increased in temperature upon printing on many sheets at a high speed. As a result, the fixing upper limit temperature is preferably high. The fixing upper limit temperature of 170° C. or more is practically acceptable.

Evaluation criteria are as follows:

A: Fixing upper limit temperature was higher than 185° C.

B: Fixing upper limit temperature was higher than 175° C. and 185° C. or less.

C: Fixing upper limit temperature was 170° C. to 175° C.

D: Fixing upper limit temperature was lower than 170° C.

<Storability>

A 50 mL glass container was charged with a toner, allowed to stand in a thermostat bath at 50° C. for 24 hours, and cooled to 24° C., followed by subjecting to the penetration test (JIS K2235-1991) to thereby determine penetration. Based on the penetration, storability (heat resistant storability) was evaluated. Higher penetration means more excellent heat resistant storability.

Evaluation criteria are as follows:

B: Penetration was 25 mm or more.

C: Penetration was 20 mm or more but less than 25 mm.

D: Penetration was less than 20 mm.

<Reduction of Charging Amount After Storage>

A 50 mL glass container was charged with 10 g of a toner, followed by storing in a temperature and humidity controllable thermostat bath under an environment of a temperature of 40° C. and a humidity of 75% for 10 days. Charging amounts were measured by a blow-off method before and after storage to thereby evaluate a change rate of a changing amount. From the viewpoint of developing stability against environmental impact, the change rate is preferably small.

Evaluation criteria are as follows:

B: Change rate of charging amount after storage relative to charging amount before storage was 0% to 15%.

D: Change rate of charging amount after storage relative to charging amount before storage was greater than 15%.

<Overall Judgment>

Overall judgment was performed according to the following evaluation criteria.

[Evaluation Criteria]

A: The evaluation of the fixing lower limit temperature was A, and the evaluations in the other evaluation items were B or better.

B: The evaluation of the fixing lower limit temperature was B, and the evaluations in the other evaluation items were B or better.

C: One of the evaluations of the fixing lower limit temperature, the fixing upper limit temperature, the storability, and the reduction of charging amount after storage was C (there was not the evaluation D in each of the evaluation items).

D: One of the evaluations of the fixing lower limit temperature, the fixing upper limit temperature, the storability, and the reduction of charging amount after storage was D.

The evaluation results and overall judgment are presented in

Table 2. In the overall judgment, "C" means a practically acceptable level; "B" means being superior to "C"; "A" means being superior to "B"; and "D" means being inferior to "C."

TABLE 2

| | Fixing lower limit Temperature (° C.) | Fixing upper limit Temperature (° C.) | Stor-ability | Reduction of charging amount after storage (μC/g) | Overall judgement |
|---|---|---|---|---|---|
| Ex. 1 | A | B | B | B | A |
| Ex. 2 | A | B | B | B | A |
| Ex. 3 | A | B | B | B | A |
| Ex. 4 | A | B | B | B | A |
| Ex. 5 | B | B | B | B | B |
| Ex. 6 | B | B | B | B | B |
| Ex. 7 | B | B | B | B | B |
| Ex. 8 | B | B | B | B | B |
| Ex. 9 | C | B | B | B | C |
| Ex. 10 | C | B | B | B | C |
| Ex. 11 | C | B | B | B | C |
| Ex. 12 | C | B | B | B | C |
| Ex. 13 | A | B | B | B | A |
| Ex. 14 | A | B | B | B | A |
| Ex. 15 | C | A | B | B | C |
| Ex. 16 | B | C | B | B | C |
| Ex. 17 | A | C | C | B | C |
| Ex. 18 | A | C | C | B | C |
| Ex. 19 | A | C | C | B | C |

TABLE 2-continued

| | Fixing lower limit Temperature (° C.) | Fixing upper limit Temperature (° C.) | Stor-ability | Reduction of charging amount after storage (μC/g) | Overall judgement |
|---|---|---|---|---|---|
| Comp. Ex. 1 | D | B | B | B | D |
| Comp. Ex. 2 | C | B | B | D | D |
| Comp. Ex. 3 | D | B | B | B | D |
| Comp. Ex. 4 | D | B | B | B | D |
| Comp. Ex. 5 | B | B | B | D | B |
| Comp. Ex. 6 | D | B | B | B | D |
| Comp. Ex. 7 | A | B | D | B | D |
| Comp. Ex. 8 | A | B | B | D | D |
| Comp. Ex. 9 | A | B | D | B | D |
| Comp. Ex. 10 | D | B | B | B | D |

As described above, in Examples 1 to 19, excellent toners were obtained that had a practically acceptable fixing lower limit temperature, a small change rate of charging amount due to influence of temperature and humidity, an acceptable hot offset resistance, and an acceptable storability.

In Comparative Examples 1 and 3, the Tfb was higher than 100.0° C., resulting in deterioration of the fixing lower limit temperature.

In Comparative Examples 7 and 9, the Tfb was lower than 55.0° C., resulting in deterioration of the storability.

In Comparative Examples 2, 5 and 8, the amount of the component soluble in a 50% by mass aqueous methanol solution was higher than 0.60% by mass, resulting in great deterioration of the charge rate of charging amount after storage.

In Comparative Examples 4, 6 and 10, the amount of the component soluble in a 50% by mass aqueous methanol solution was lower than 0.10% by mass, resulting in deterioration of the fixing lower limit temperature.

This application claims priority to Japanese application No. 2015-000394, filed on January 5, 2015 and incorporated herein by reference.

What is claimed is:

1. A toner comprising:

a binder resin comprising a crystalline polyester resin and a noncrystalline polyester resin, said noncrystalline polyester resin being an unmodified aromatic polyester resin prepared by reacting an alcohol component with a carboxylic acid component in a OH/COOH ratio of 1.293 to 1.364, followed by further reaction with 10 parts by mass to 29 parts by mass of benzoic acid to 600 parts by mass of the total of the alcohol component and the carboxylic acid component; and a release agent, wherein the toner comprises a soluble component in an amount of 0.10% by mass to 0.60% by mass where the soluble component is a component soluble in a 50% by mass aqueous methanol solution, and wherein the toner has a flowing-out beginning temperature (Tfb) of 55.0° C. to 100.0° C. as determined by a flowtester method.

2. The toner according to claim 1, wherein the toner has the flowing-out beginning temperature (Tfb) of 55.0° C. to 85.0° C.

3. The toner according to claim 1, wherein the toner has the flowing-out beginning temperature (Tfb) of 55.0° C. to 75.0° C.

4. The toner according to claim 1, wherein the toner comprises an insoluble component in an amount of 15% by mass to 30% by mass where the insoluble component is a component insoluble in ethyl acetate.

5. An image forming apparatus comprising:

an electrostatic latent image bearer;

a charging unit configured to charge a surface of the electrostatic latent image bearer;

an exposure unit configured to expose the surface charged of the electrostatic latent image bearer to light to form an electrostatic latent image;

a developing unit containing the toner of claim 1 and configured to develop the electrostatic latent image with the toner to forma visible image;

a transfer unit configured to transfer the visible image onto a recording medium to form a transferred image; and a fixing unit configured to fix the transferred image on the recording medium.

6. A process cartridge comprising:

an electrostatic latent image bearer; and a developing unit containing the toner of Claim I and configured to develop an electrostatic latent image on the electrostatic latent image bearer with the toner, wherein the process cartridge supports the electrostatic latent image bearer and the developing unit in an integrated stale, and wherein the process cartridge is detachably mounted to a main body of an image forming apparatus.

7. The toner according to claim 1, wherein the unmodified aromatic polyester resin has an acid value of 5 KOHmg/g to 30 KOHmg/g and a hydroxyl value of 10 KOHmg/g to 30 KOHmg/g.

* * * * *